US009848704B1

(12) United States Patent
Pollard et al.

(10) Patent No.: US 9,848,704 B1
(45) Date of Patent: Dec. 26, 2017

(54) LIFT CHAIR AND RECLINER

(71) Applicant: Golden Technologies, Inc., Old Forge, PA (US)

(72) Inventors: W. Edward Pollard, Falls, PA (US); James Olcheski, Duryea, PA (US)

( * ) Notice: Subject to any disclaimer, the term of this patent is extended or adjusted under 35 U.S.C. 154(b) by 450 days.

(21) Appl. No.: 13/950,012

(22) Filed: Jul. 24, 2013

Related U.S. Application Data

(63) Continuation of application No. 13/851,043, filed on Mar. 26, 2013, now Pat. No. 9,016,788, which is a continuation of application No. 12/467,024, filed on May 15, 2009, now Pat. No. 8,403,409, which is a continuation of application No. 11/225,628, filed on Sep. 13, 2005, now Pat. No. 7,543,885.

(60) Provisional application No. 60/609,415, filed on Sep. 13, 2004.

(51) Int. Cl.
*A47C 1/024* (2006.01)
*A61G 5/14* (2006.01)

(52) U.S. Cl.
CPC ..... *A47C 1/024* (2013.01); *A61G 5/14* (2013.01)

(58) Field of Classification Search
USPC ..... 297/85 M, 330, 69, 362.11, 344.12, 297/344.15, 344.17
See application file for complete search history.

(56) References Cited

U.S. PATENT DOCUMENTS 3,016,264 A 1/1962 Hughes
3,743,348 A 7/1973 Sloan
4,007,960 A 2/1977 Gaffney
4,365,836 A 12/1982 Jackson et al.
4,386,803 A 6/1983 Gilderbloom
4,852,939 A 8/1989 Krauska
5,013,084 A 5/1991 May
5,061,010 A * 10/1991 LaPointe ..... 297/325
5,165,753 A 11/1992 Henderson
5,265,935 A 11/1993 Geisler et al.
5,312,153 A 5/1994 Lin
5,354,116 A 10/1994 May et al.
5,498,055 A 3/1996 Goldman
5,520,439 A 5/1996 Blount
5,582,457 A 12/1996 Komorowski et al.
(Continued)

FOREIGN PATENT DOCUMENTS

DE 9420149 U1 2/1995
GB 2030854 4/1980
(Continued)

*Primary Examiner* — Philip Gabler
(74) *Attorney, Agent, or Firm* — Clinton H. Wilkinson; Charles A. Wilkinson

(57) ABSTRACT

A lift and recliner chair which is positionable in multiple reclining positions including both a Trendelenburg and zero-gravity position, in which using an actuator mechanism the position of the back frame can be adjusted in any lift and/or reclining position the chair is capable of achieving without requiring any movement or adjustment to the position of the seat frame or footrest. The actuator mechanism is secured between the back frame and the seat frame or another component of the lift/recline assembly that follows or moves with the seat frame as the chair is moved between a lift and reclining position, while in one embodiment the angle of the footrest is independently adjustable using a separate actuator mechanism.

18 Claims, 36 Drawing Sheets

(56) References Cited

U.S. PATENT DOCUMENTS

| | | | | |
|---|---|---|---|---|
| 5,651,580 | A | 7/1997 | LaPointe et al. | |
| 5,806,920 | A | 9/1998 | Blount | |
| 5,845,961 | A | 12/1998 | LaPointe et al. | |
| 6,000,758 | A | 12/1999 | Schaffner et al. | |
| 6,022,076 | A | 2/2000 | Samson | |
| 6,135,559 | A | 10/2000 | Kowalski | |
| 6,142,558 | A | 11/2000 | May | |
| 6,213,554 | B1 | 4/2001 | Marcoux et al. | |
| 6,557,940 | B2 * | 5/2003 | Hayashi et al. | 297/330 |
| 6,659,556 | B2 * | 12/2003 | Pellerin | 297/330 |
| 6,726,276 | B1 * | 4/2004 | Tholkes et al. | 297/172 |
| 6,840,575 | B2 * | 1/2005 | Hesse | 297/85 M |
| 6,846,042 | B2 * | 1/2005 | Hanson et al. | 297/411.36 |
| 7,543,885 | B2 * | 6/2009 | Pollard et al. | 297/85 R |
| 8,403,409 | B2 | 3/2013 | Pollard et al. | |
| 8,459,733 | B2 * | 6/2013 | Hoffman et al. | 297/85 M |
| 2009/0278395 | A1 * | 11/2009 | Pollard et al. | 297/85 M |

FOREIGN PATENT DOCUMENTS

| | | |
|---|---|---|
| GB | 2407493 | 4/2005 |
| WO | 02087389 | 11/2002 |

* cited by examiner

LIFT CHAIR AND RECLINER

CROSS-REFERENCE TO PREVIOUS RELATED APPLICATION

This application is a continuation-in-part of U.S. patent application Ser. No. 13/851,043, which is a continuation of U.S. Pat. No. 8,403,409 issued on Mar. 26, 2013, which is a continuation of U.S. Pat. No. 7,543,885 issued on Jun. 9, 2009, which claims priority to U.S. Provisional Pat. Appln. Ser. No. 60/609,415, filed on Sep. 13, 2004, the entirety of the disclosures of which applications and patents is hereby incorporated by reference.

BACKGROUND OF THE INVENTION

1. Field of the Invention

The present invention relates to chairs in general, and more particularly to recliner chairs and lift chairs, and more particularly still to recliner and lift chairs in which the angle and position of the back frame is adjustable using a reversible electronic actuator independent of any movement or positioning of the seat frame and footrest, and more particularly still to reclining and lift chairs in which the chair can be positioned in both a zero gravity and Trendelenburg position.

2. Preliminary Discussion

Recliner chairs and lift chairs have been on the market for years, with the utility of recliners being primarily for leisure use in living rooms and family rooms, while lift chairs are used primarily by the handicapped, elderly, or disabled to assist them in moving from a reclined or sitting position into a standing position. While a substantial number of today's recliners are still manually operated, a growing number of recliners, and almost all lift chairs, utilize one or more actuator mechanisms to move the footrest, back frame, and seat frame into various lift and/or recline positions with respect to each other. In one known chair type, independent movement of the footrest and backrest is accomplished through the use of separate actuators, while other chairs utilize a single interconnected actuator to cause the footrest and backrest to move together or simultaneously. In known recliner chairs in which the back frame is independently movable, the back frame actuator connects between the back frame and either the chair frame or lift frame. Unfortunately, the range of movement in which the back frame can be pivoted or moved using the back frame actuator without one or more parts of the actuator mechanism being impeded or obstructed by another part or component of the chair, such as the chair frame, lift frame actuator, or seat frame, is rather limited, and in some chairs also depends upon the particular lift or recline position the chair is in. In other words, despite the use of a separate chair back actuator, the position adjustability of the back frame is still limited.

In addition to the usual television watching and other relaxing positions, a few known chairs can also be moved or pivoted into certain special positions. One such position is the so-called Trendelenburg position, wherein the occupant's legs are situated so that they are higher in relation to the ground than the heart. This position is useful particularly for those having certain circulatory, kidney, or other ailments, since in such position gravity assists the flow of blood from the legs back to the heart. Another special position is the so-called "zero gravity" or 90/90 position. To achieve such position, the chair is adjusted so that the occupant's head and torso are at a slight upward angle, the legs up to the knee are bent at a similar opposite upward angle, and the knees are bent so that the lower area of the legs is angled similarly to the torso. The zero-gravity position approximates the position or posture that astronauts assume when sleeping in a weightless environment. The primary benefit of such position is reduced pressure on the spine, which often relieves back pain at least to some extent. Other benefits include reduced heart stress, relief of tension in the body, and improved circulation. So far as the inventors are aware, no prior art motor actuated reclining lift chairs or recliners can achieve both the Trendelenburg and zero-gravity positions as well as independent movement of the back frame relative to the seat frame and footrest throughout its full range of motion regardless of the lift or recline position the chair is in.

It has now been discovered that by securing the actuator mechanism for independently adjusting the position or angle of the back frame with respect to the seat frame between the back frame or linkages connected to the back frame on one end and the seat frame or linkages connected to, or moving along with or following the movement of the seat frame on the other end, such that the back frame actuator can follow or move along with the seat as the position of the seat is adjusted using another actuator, the back frame can be moved to any position the actuator mechanism is capable of providing without being impeded by or coming into contact with any other parts of the chair, in any lift and/or recline position the chair is capable of achieving. Thus, in one embodiment, as the footrest pivots upwardly, the seat and back frames as a result of the particular linkage mechanism selected will at the same time move rearwardly until the footrest is in a substantially horizontal position. Then, if one tries to move the footrest beyond such substantially horizontal position, the footrest as well as the seat and back frames will both move together in a generally upward direction. At the same time, or at a different time, the back frame can be moved independently of both the footrest and seat frame using its own actuator. In another embodiment, the footrest can also be operated and its position adjusted independent of both the seat frame and back frame using a third actuator.

Where such a back frame actuator and linkage mechanism arrangement is provided on a combination recliner and lift chair, the actuator for the footrest and seat frame will be moved to a closed position and then continue beyond such position until the frame of the chair is lifted upwardly and tilted forwardly by the lift assembly. By arranging the actuators in such a manner, the chair can provide multiple positioning of the occupant or user ranging from the Trendelenburg position to various recline and lift positions. Such arrangement also enables the footrest, back frame, and seat frame to move together if desired, while moving the footrest and seat together, with the seat moving rearwardly, allows the seat to be articulated up at an angle which is comfortable and puts the occupant in a so-called "zero gravity" or back relief position, which provides complete support for the occupant and takes pressure off the spine. Where the footrest is not also independently adjustable, a size-adjustable stop may be used to alter slightly the final angle of the footrest in relation to the seat frame to customize the zero gravity position of the chair.

3. Description of Related Art

The related art evidences multiple chairs consisting of known and expected structural configurations designed to move between a reclined position, a sitting position, and a lift position wherein the occupant is enabled more easily to assume a standing or upright position, as well as a wide range of alternative designs that have been developed to fulfill countless specific objectives and requirements. The following patent documents are illustrative of the present state of this field.

U.S. Pat. No. 3,016,264 issued to A. L. Hughes on Jan. 9, 1962, entitled "Motor-Operated Reclining Chair", discloses a recliner wherein the backrest is pivotally mounted to the side arms of the chair, and is movable by a drive mechanism. However, the back rest is prevented from freely pivoting by a pair of parallel spaced-apart linkages, and therefore suffers from the disadvantage of having a limited range of motion.

U.S. Pat. No. 3,743,348 issued to C. J. Sloan on Jul. 3, 1973, entitled "Reclining Chair and Mechanism Therefore", discloses a recliner assembly wherein in one embodiment, dual motors are provided, with motor 120 being used to pivot the back frame, while motor 126 is used to deploy the footrest. When back frame motor 120 is actuated, however, due to the nature of the linkage arrangement movement of the back frame causes the rear end of the seat frame to drop and then move upwardly, thus limiting the number of reclining positions.

U.S. Pat. No. 4,007,960 issued to E. J. Gaffney et al. on Feb. 15, 1977, entitled "Reclining Elevator Chair", discloses a lift-recliner chair which is movable to a substantially fully reclined position; however, the back frame is movable with respect to the seat only when the entire chair is being moved to a reclined position, rather than moved independently of the position of the seat frame and footrest.

U.S. Pat. No. 4,365,836 issued to W. R. Jackson et al. on Dec. 28, 1982, entitled "Motorized Reclining Chair", discloses a recliner chair having a single motor or actuator. While the linkage system for such chair enables it to be moved to a conventional television viewing position and a resting position, there is no means for changing the position of the backrest independently of the position of the seat frame or footrest.

U.S. Pat. No. 4,386,803 issued to C. W. Gilderbloom on Jun. 7, 1983, entitled "Motorized Reclining Chair", discloses a recliner wherein the chair back, seat, and legrest are said to be independently adjustable. However, while such chair appears to be capable of attaining a wider than usual range of reclining positions, the seat is separately connected to the frame on roller guides, and is moved on the guides in response to abutting contact with the back as it is moved using the back motor. In addition, the footrest or ottoman does not retract to a conventional closed recliner position.

U.S. Pat. No. 4,852,939 issued to B. J. Krauska on Aug. 1, 1989, entitled "Device for Converting a Recliner Chair to a Recliner-Lift Chair", discloses a chair base that when connected to a conventional recliner converts it into a power actuated recliner and lift chair. The back frame, however, is not independently movable, and therefore the number of reclining positions that can be achieved with such chair is comparatively limited.

U.S. Pat. No. 5,013,084 issued to T. J. May on May 7, 1991, entitled "Mechanism for High-Leg Reclining Apparatus", discloses a dual legrest type recliner chair capable of attaining an upright, TV, and fully reclined position. The linkage of the chair back frame to the seat frame does not allow for independent movement of the chair back, however.

U.S. Pat. No. 5,165,753 issued to E. D. Henderson on Nov. 24, 1992, entitled "Elevator Chair Apparatus" discloses a lift chair wherein the sub-frame pivots on a base portion having a rearwardly inclined upper surface. In a lift position, the sub-frame pivots on the front edge of the inclined surface via an actuator.

U.S. Pat. No. 5,520,439 issued to E. D. Blount on May 28, 1996 entitled "Fully Reclinable Elevator Lift Chair", discloses a lift-recliner chair that is an improvement on the Henderson '753 chair in that it can also be moved to a fully reclined position, while the Henderson chair cannot. The actuator in Blount is connected between the base and a pivotable transverse bar on which the back is supported by brackets, so that when the motor ram is moved away from the motor, eventually the bar pivots to cause the back to recline. See also commonly owned continuation-in-part U.S. Pat. No. 5,806,920 entitled "Fully Reclinable Elevator Lift Chair with Ottoman" wherein an elevatable footrest is also provided. None of such arrangements appears to allow for completely independent adjustment of the back frame, however.

U.S. Pat. No. 5,265,935 issued to G. Geisler et al. on Nov. 30, 1993, entitled "Stand-Assist Recliner Chair", discloses a lift-recliner chair in which the actuator is secured between two separate crank arms under the chair seat. The linkage mechanism used, however, does not appear to provide the same maneuverability of the back section as is possible with the present inventors' arrangement.

U.S. Pat. No. 5,312,153 issued to J. Lin on May 17, 1994, entitled "Recline Lift Wall Hugger Chair", discloses an arrangement for enabling a chair to pivot forwardly, or away, from a wall when it is to be moved into a reclining position. In the embodiment shown in FIGS. 12-14, the backrest is tiltable relative to the seat using a crank arm connection arrangement between the backrest and seat. However, the seat still must move forwardly for the back to achieve a fully reclined position, and there is no means for independently pivoting the backrest with respect to the seat portion.

U.S. Pat. No. 5,354,116 issued to T. J. May et al. on Oct. 11, 1994, entitled "Reclining Chair with Articulating Linkage for Padded Intermediate Ottoman", discloses a recliner having a linkage mechanism connecting the legrest, seat, and backrest. The linkage system does not provided for independent movement of the backrest, however.

U.S. Pat. No. 5,498,055 issued to P. R. Goldman on Mar. 12, 1996, entitled "Recliner Apparatus and Method", discloses a recliner wherein the user's feet are elevated above his or her heart in a fully reclined position. As shown in FIG. 2, the entire chair can pivot about an axis (21) in relation to the chair frame (13), while the seat and back as well as the seat and footrest are also independently pivotable with respect to one another, so that numerous reclined positions are possible, one of which is to have the footrest raised upwardly so that the user's feet are above his or her heart. A means for automatically moving the footrest when the backrest is rotated is also provided. While the Goldman recliner therefore can be moved into a Trendelenburg position, this is accomplished in a completely unique manner unlike the present invention and without the use of motorized actuators, and it is unclear whether a bed-like position can be reached.

U.S. Pat. No. 5,582,457 issued to K. J. Komorowski et al. on Dec. 10, 1996, entitled "Dual Legrest Assembly", discloses a linkage assembly for a legrest wherein coordinated movement of first and second legrest panels, i.e., a dual legrest, is provided. A separate linkage means for tilting the backrest is also shown, but the back frame is not movable via a power actuator means.

U.S. Pat. No. 5,651,580 issued to L. P. LaPointe et al. on Jul. 29, 1997, entitled "Linear Actuation Drive Mechanism for Power-Assisted Chairs and Base Therefor", discloses a lift-recliner chair that utilizes a single linear action drive mechanism to selectively actuate the reclining linkage assembly, footrest linkage assembly, and the lift and tilt assembly. Such chair, which is the subject of several related patents, does not appear to include a motor actuated system for independently adjusting the position of the backrest.

U.S. Pat. No. 6,000,758 issued to W. E. Schaffner et al. on Dec. 14, 1999, entitled "Reclining Lift Chair", discloses a chair having a novel linkage mechanism system for lifting and reclining in which when a bell crank is pivoted in a clockwise direction by an actuator, the chair back is caused to recline, and in addition having an environmental control system. There does not appear to be a means for independently adjusting the position of the chair back with respect to the chair seat frame in any of the disclosed embodiments, however, so that the range of positions in which the chair can be reclined is limited in comparison to the present invention.

U.S. Pat. No. 6,022,076 issued to I. Samson on Feb. 8, 2000, entitled "Reclinable Seating", discloses a recliner chair in which the center of gravity of the reclining unit remains in a horizontal plane as it moves between an upright and reclined position, thereby increasing the stability of such chair in these positions. While the Samson recliner appears to possibly be movable to a zero-gravity position, such chair does not disclose any of the unique features of the present invention.

U.S. Pat. No. 6,135,559 issued to J. R. Kowalski on Oct. 24, 2000, entitled "Seat Back Reclining Mechanism Adaptable to Chairs with Stationary or Movable Seats", discloses a recliner that includes a linkage mechanism for pivoting the seat back independent of and without regard to the position of the seat. However, movement of the back is initiated by applying a manual force against the chair back and opposing the force of a coil spring, rather than utilizing a power actuator to move the seat, and the number of reclined positions is limited in comparison to the present invention.

U.S. Pat. No. 6,142,558 issued to T. J. May on Nov. 7, 2000, entitled "Recliner with Primary and Secondary Ottomans", discloses a "low leg" recliner chair having a unitary linkage arrangement for the chair legrest, seat, and back. The May chair is not motor actuated, however, and the backrest appears to pivot in unison with the seat, rather than completely independent of the seat movements as in the present invention.

U.S. Pat. No. 6,213,554 issued to Y. Marcoux et al. on Apr. 10, 2001, entitled "Lift Chair", discloses a lift chair mechanism for a lift chair having a chair frame that can be reclined independently of the lift mechanism and base frame, as well as providing for a rocking motion. The chair back cannot be reclined independent of the seat frame, however.

U.S. Pat. No. 6,840,575 issued D. Hesse on Jan. 11, 2005, entitled "Seat-Recliner Fitting That Can Be Adjusted by a Motor", discloses a fitting for adjusting the inclination of a seat back and a footrest of a recliner using separate actuators. The specification indicates that the seat is moved forward at the same time the back is moved. In addition, the linkage mechanism on which the seat is pivoted is unlike that of the present lift-recliner chair, and use of an adjustable size spacer for microadjustment of the angle of the footrest in a fully reclined position is not disclosed.

German Gebrauchmuster Patent Application DE 9420149.8 filed by W. Hoormann et al. on Dec. 16, 1994, discloses in FIGS. 1 and 2 a recliner having a pair of actuators or motors, one of which is connected to the backrest. The backrest motor appears to be connected to a stationary position on the chair frame rather than the seat, and therefore would not provide the same advantages available in the present invention.

U.K. Patent Application 2,030,854 published on Apr. 16, 1980, entitled "Reclining Chair", discloses a recliner wherein the seat and back are pivotally connected to the base as well as to each other. When the back pivots, the seat also must pivot, so that there does not appear to be a means for pivoting the seat independently of the back.

U.K. Patent Application No. 2,407,493 published on Apr. 5, 2005 entitled "Powered Lift Reclining Chair", discloses a lift-recliner chair having an actuator for pivoting the back portion with respect to the seat portion, as well as the seat portion with respect to the base portion. The actuators are substantially enclosed within the base portion of the chair at all positions of the chair, which arrangement reduces the risk of entrapment and injury during movement of the chair (as shown in FIGS. 2 and 3). It is indicated that the actuator for moving the back portion is "fixed" relative to the seat portion. As shown in FIG. 2, however, actuator (66) is mounted to base frame cross member (26) on one end and the actuator arm (67) is mounted to cross member (60), not the seat frame.

While the aforementioned prior art devices fulfill their respective, particular objectives and requirements, they do not disclose a lift or recliner chair having the particular capabilities and advantages of the present invention. The chair according to the present invention substantially departs from the conventional concepts and designs of the prior art, and in doing so provides a lift and recliner chair having an independently operating back and in one embodiment a movement rearwardly and upwardly of the seat to a substantially reclining position as the footrest is activated, that is capable of easily achieving a wider range of reclining positions, including both a Trendelenburg and zero-gravity position.

OBJECTS OF THE INVENTION

It is therefore a primary object of the invention to provide a combination lift chair and reclining chair in which the chair is movable from a sitting or upright position to either a lift position on the one hand or a Trendelenburg position on the other hand.

It is a further object of the invention to provide a combination lift chair and Trendelenburg chair.

It is a still further object of the invention to provide a combination reclining and lift chair in which in one embodiment the seat lifts in combination with the footrest to provide a raised position that can be varied with various positions of the back to provide multiple resting positions.

It is a still further object of the invention to provide a reclining chair capable of achieving a larger variety of positions than have been previously available.

It is a still further object of the invention to provide a lift chair with a novel mechanical arrangement for providing a variety of positions for the occupant.

Is a still further object of the invention to provide a lift chair with a linkage system and arrangement that provides a plurality of resting positions for the occupant as well as a position for aiding the occupant to arise from the chair.

It is a still further object of the invention to provide a lift chair which is enabled to have an independently operating back in which the operating motor for the back in one embodiment is anchored to the seat frame, and in another embodiment is anchored to stay in the same general relative position with respect to the seat frame at all times as the seat is moved.

It is a still further object of the invention to provide a lift and reclining chair that can achieve both a Trendelenburg reclined position and a zero-gravity reclined position.

It is a still further object of the invention to provide a spacer means for adjusting slightly the angle of the footrest in a fully reclined position in one chair embodiment.

It is a still further object of the invention to provide a lift and reclining chair having an independently positionable back frame having a linkage mechanism that is strong and durable and stable enough to withstand repeated use over time.

It is a still further embodiment of the invention to provide a lift and reclining chair or recliner having both an independently moveable back frame and footrest.

Still other objects and advantages of the invention will become clear upon review of the following detailed description in conjunction with the appended drawings.

SUMMARY OF THE INVENTION

A novel mechanical arrangement for use with a recliner chair or lift chair is provided involving at least two independently operating actuators or motors secured to the parts of the chair such as to allow the chair to be moved to a substantial reclining or sitting position in a central position, a Trendelenburg or legs elevated with respect to the heart elevation position on one side of a reclining or sitting position, and in some embodiments to a lift position for allowing or aiding the occupant to stand up and leave the chair on the other side of a reclining or sitting position. By pivotably connecting the operating actuator for the back in one embodiment by linkages connecting between the seat frame and back frame, the back frame actuator will move as the seat frame is moved using a separate recline or recline and lift actuator and will stay in the same general relative position with respect to the seat frame at all times. In another aspect of the invention, a linkage arrangement for accomplishing such independent pivotable movement of the chair back is also provided, while in another aspect a means for slightly adjusting the angle of the footrest in a fully reclined position, whereby the chair occupant may also adjust the chair to a customizable zero-gravity reclining position, is provided. Such mechanical arrangement can be used with any recliner and/or lift mechanism or arrangement and results in an overall more comfortable and versatile recliner. In another aspect the operating actuator for the back may be connected between the back frame and other parts of the chair that are linked to or stay in the same general relative position with respect to the seat frame at all times as the seat is moved. In one embodiment the back actuator is connected on one end to the chair bell crank substantially aligned with the lift/recline actuator, while in another embodiment the back actuator is connected between the back frame and the lift frame, either to a separate bar attached to the seat frame or to a pivotable C-shaped bar. In another aspect the chair of the invention may also be provided with an independently adjustable footrest, so that the angle or position of both the back frame and footrest can be adjusted independently.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
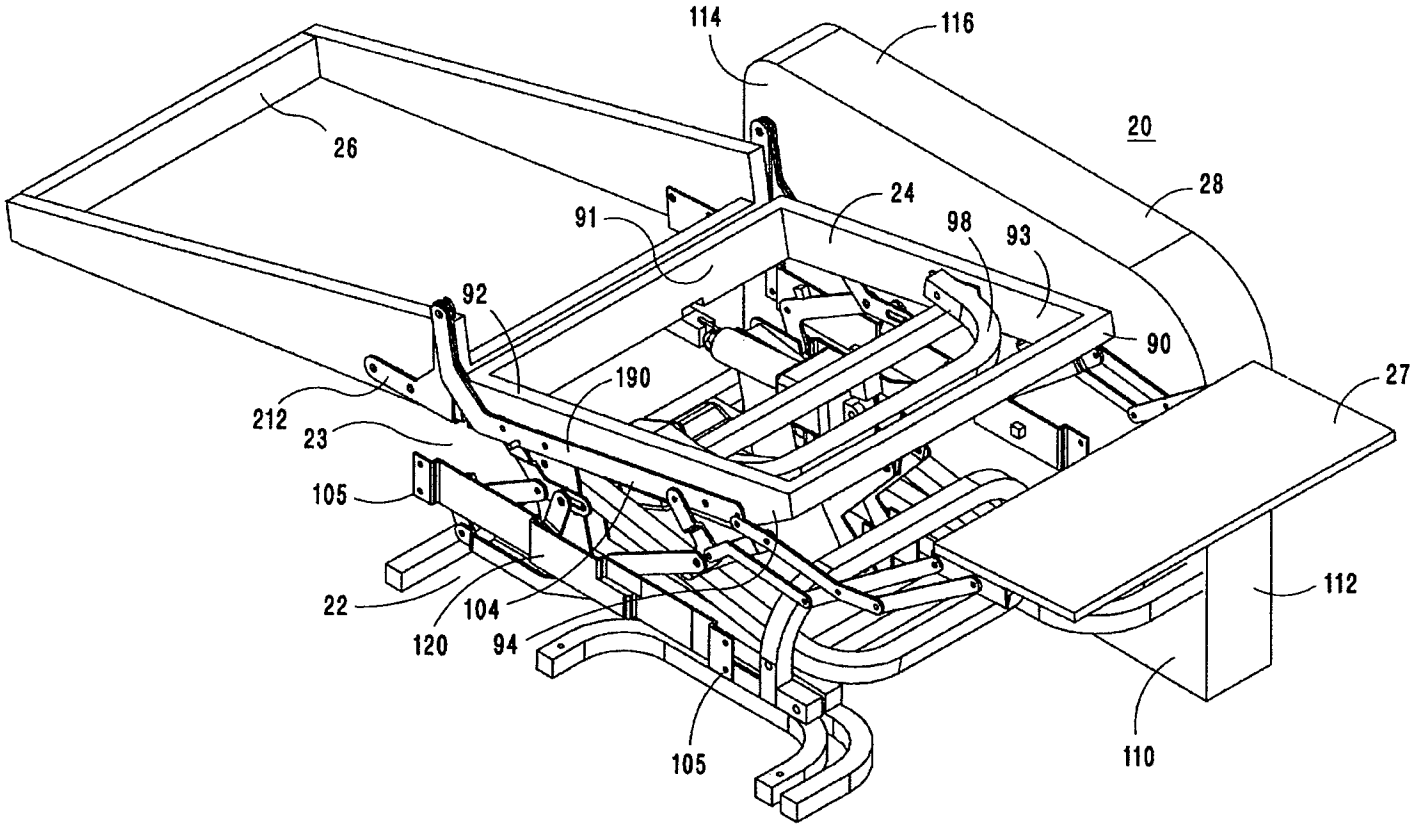
FIG. 1 is a front perspective view of the chair of the invention in a fully reclined position with most of the frame including one of the arm frames and the upholstery removed.
Figure 2:
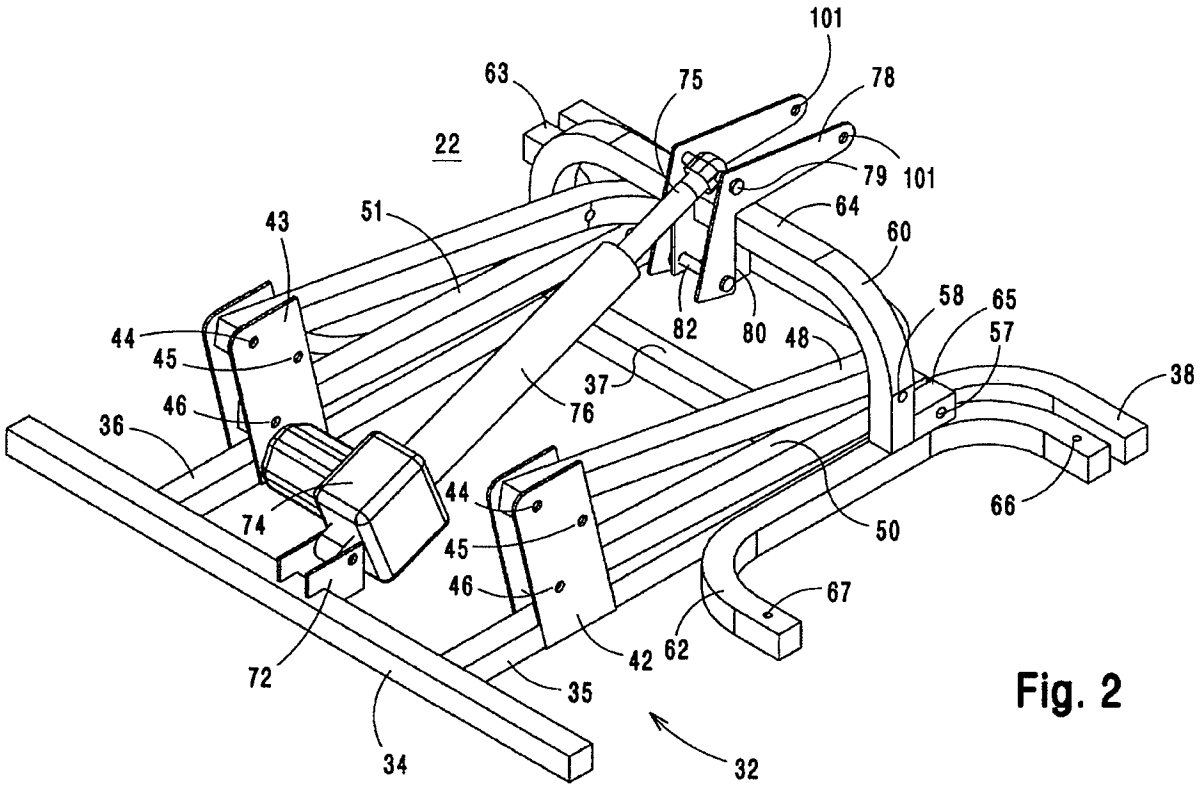
FIG. 2 is an isometric view of the lift frame or assembly of the chair in a retracted position.
Figure 3:
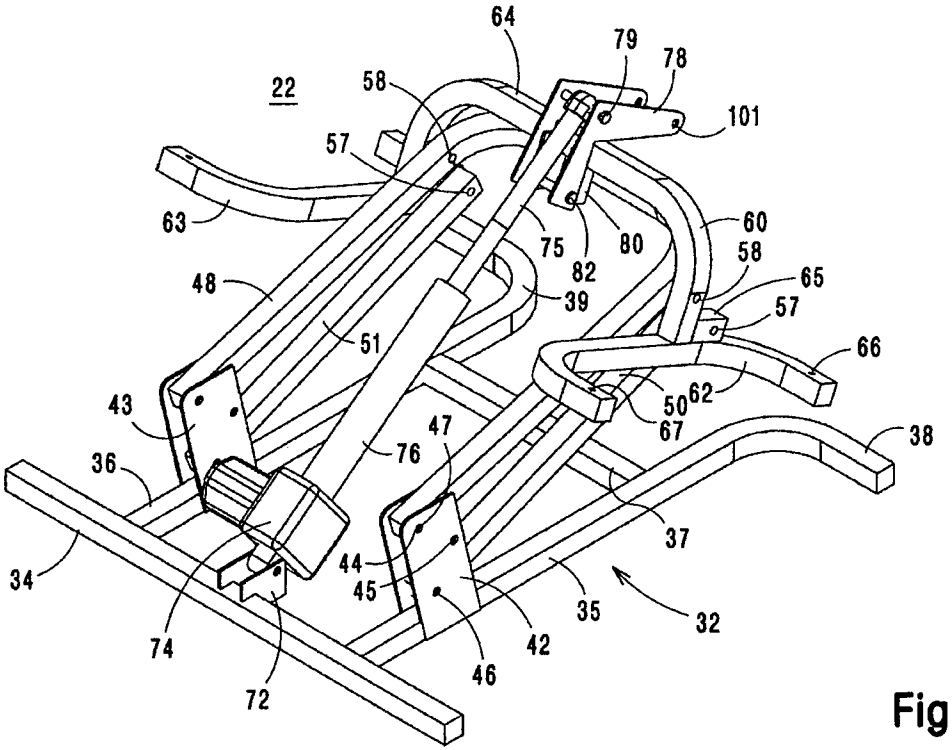
FIG. 3 is an isometric view of the lift frame or assembly of the chair in an extended position.
Figure 13:
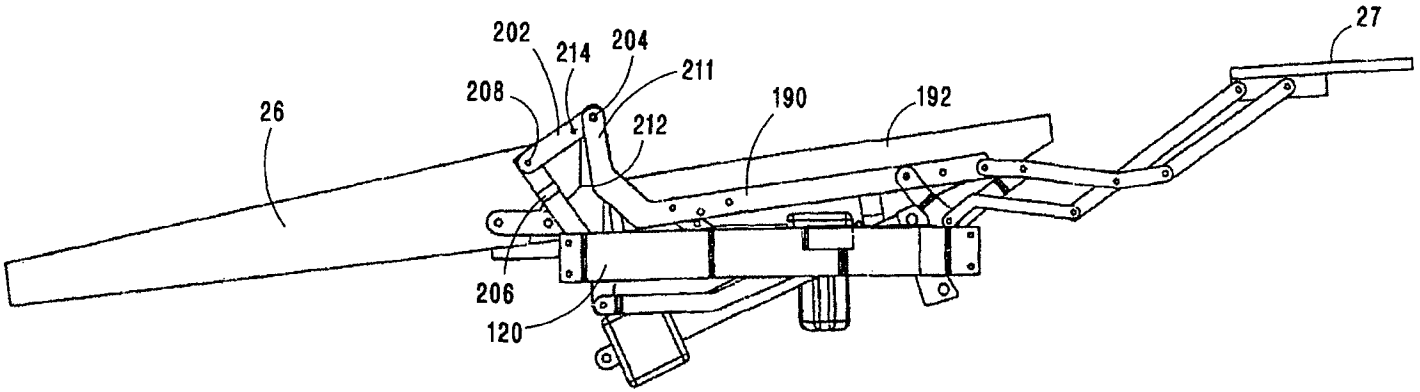
FIG. 13 is a side view showing the chair frame portion of the invention with the seat frame having an alternative preferred attachment assembly, footrest, and back frame portions of the chair of the invention in a reclined position, the seat back motor or actuator and recliner motor or actuator connected, and the recliner mechanism connected.
Figure 14:
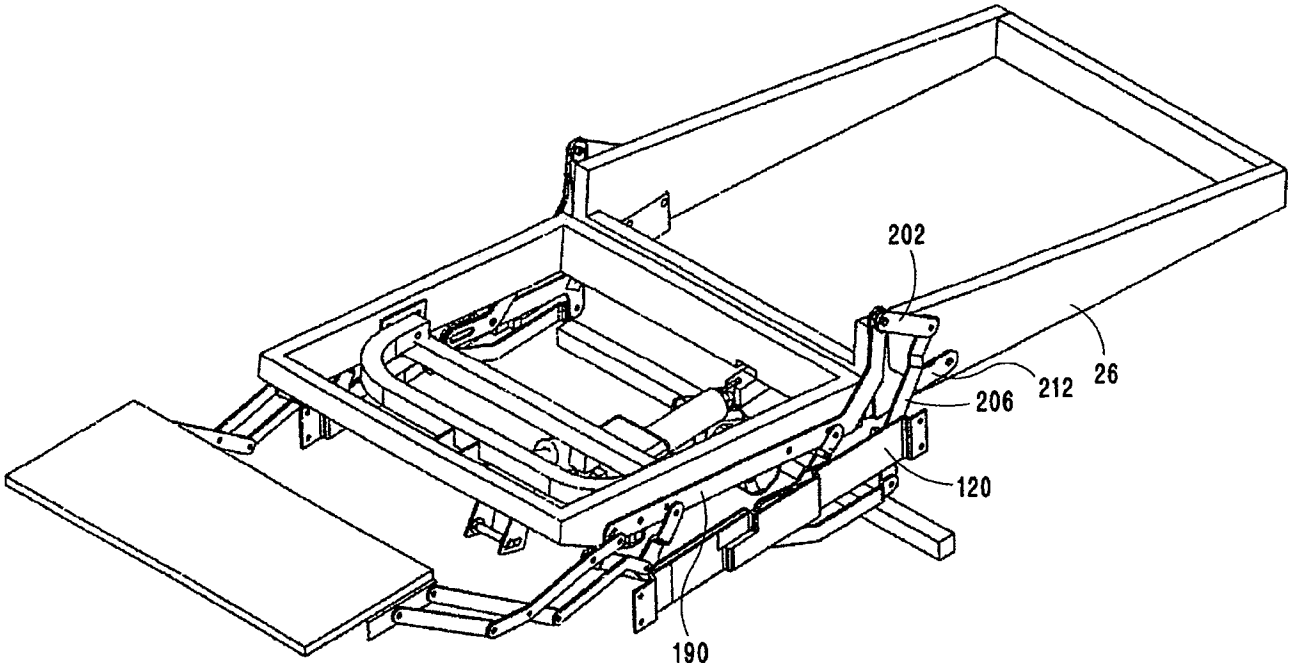
FIG. 14 is a right side perspective view of the chair frame portion of the invention similar to FIG. 13 with the seat frame, footrest, and back frame portions of the chair of the invention in a reclined position, the seat back motor or actuator and recliner motor or actuator connected, and the recliner mechanism connected.
Figure 22:
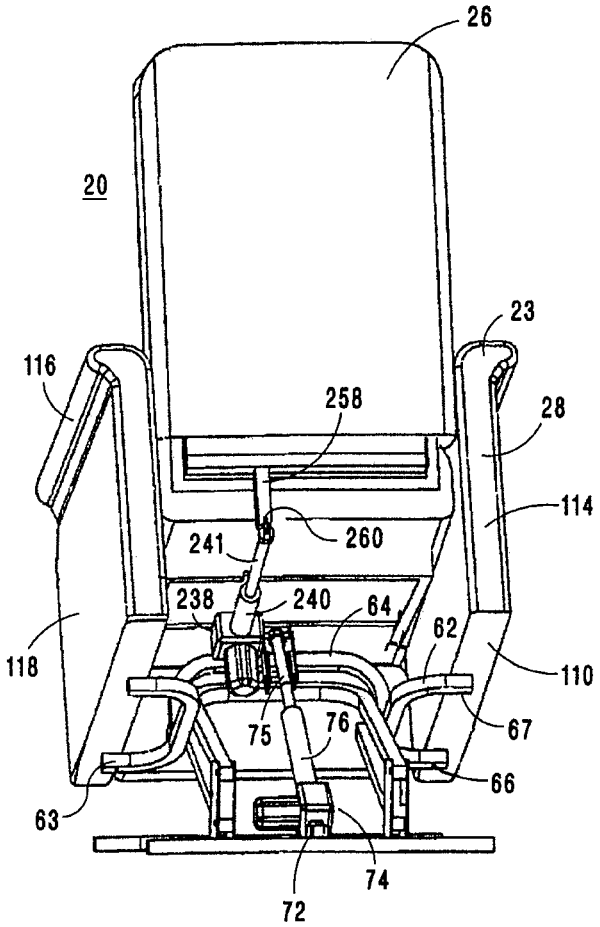
FIG. 22. is a rear view of the chair of the invention having the arm frames and upholstery thereon with the lift mechanism in a raised position.
Figure 23:
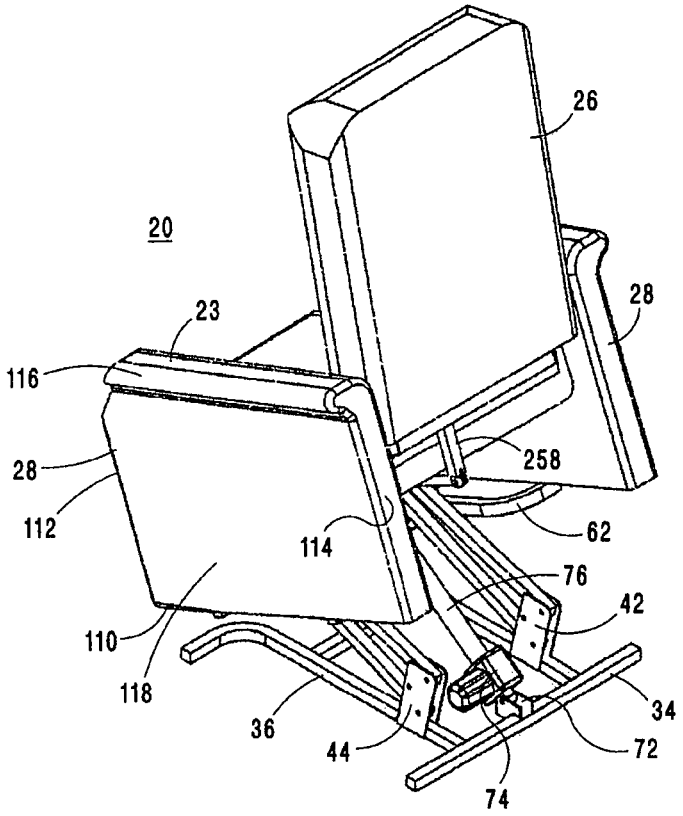
FIG. 23 is a left rear perspective view of the chair of the invention with the lift mechanism in a raised position.
Figure 31:
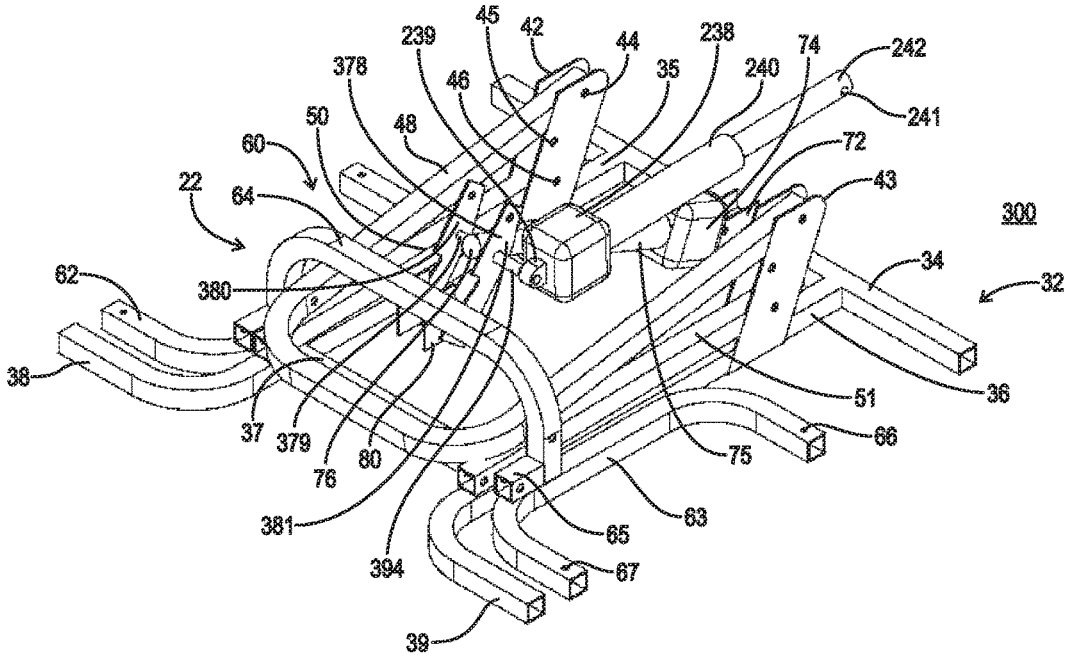
FIG. 31 is a perspective view of a chair base and lift frame illustrating another embodiment in which the back frame actuator mechanism is connected to the bell crank.
Figure 32:
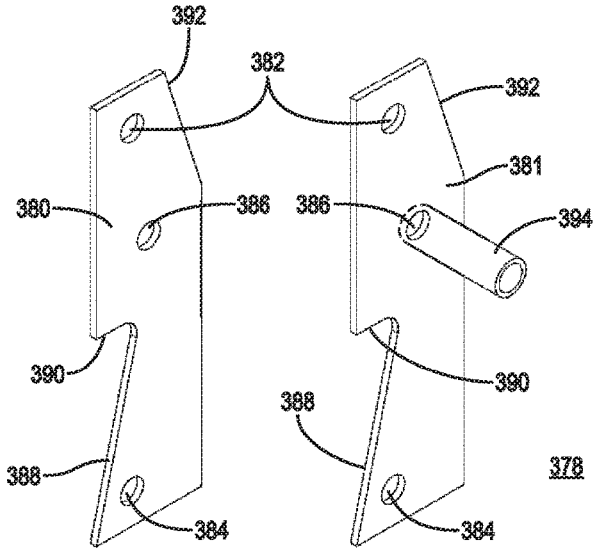
FIG. 32 is a perspective view of the particulars of the bell crank shown in FIG. 31.
Figure 33:
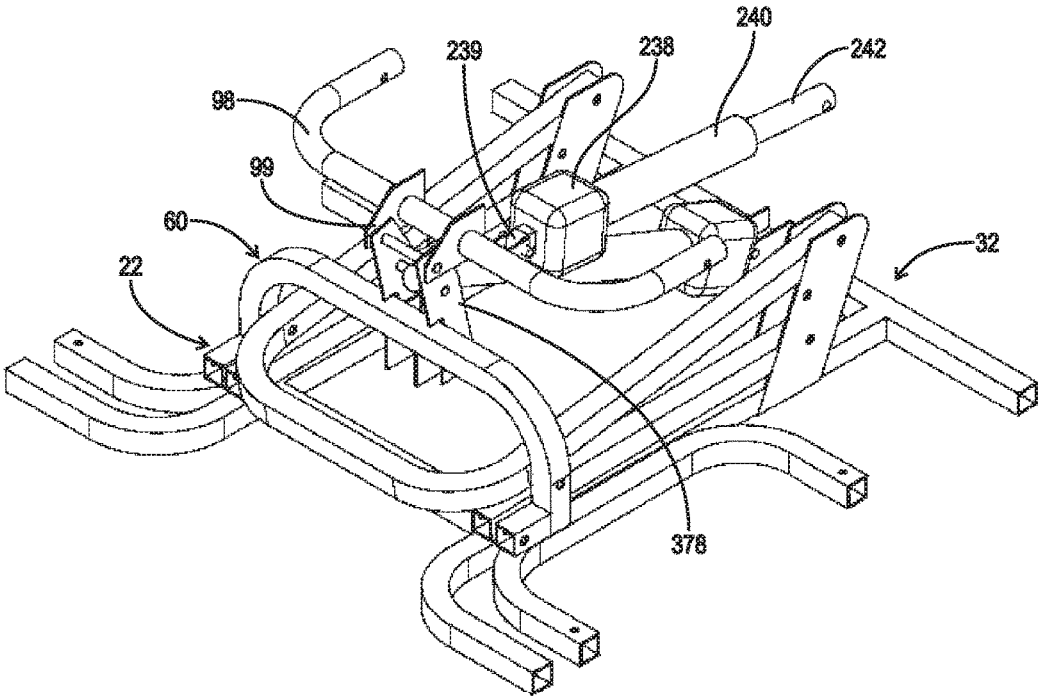
FIG. 33 is a perspective view of a chair base and lift frame illustrating another embodiment in which the back frame actuator mechanism is attached to a modified C-shaped seat bar.
Figure 34:
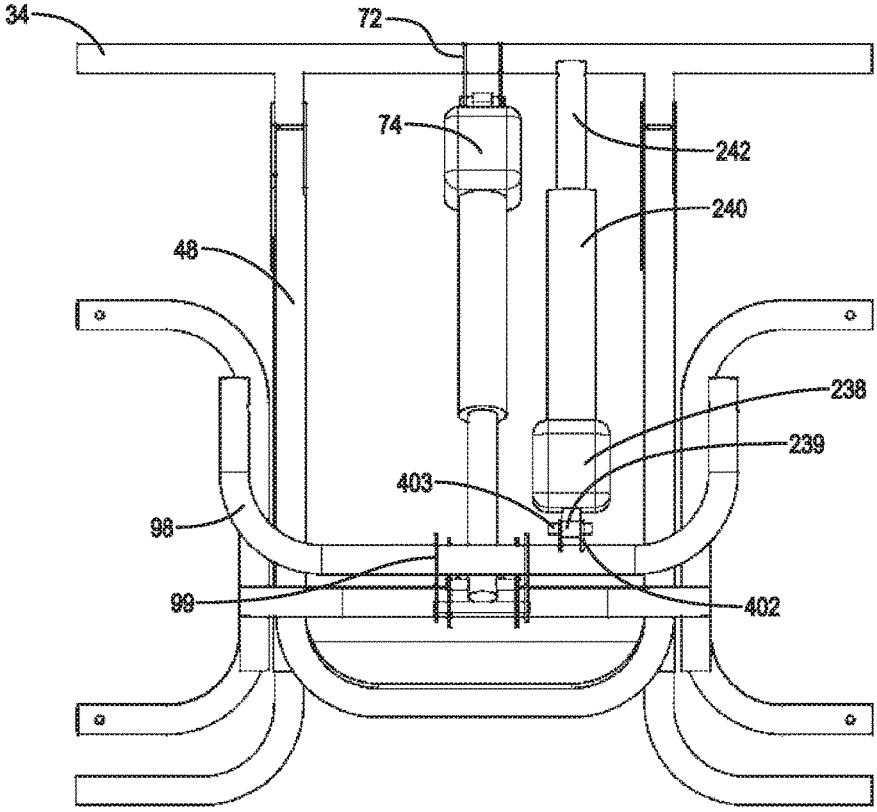
FIG. 34 is a top view of the embodiment shown in FIG. 33.
Figure 35:
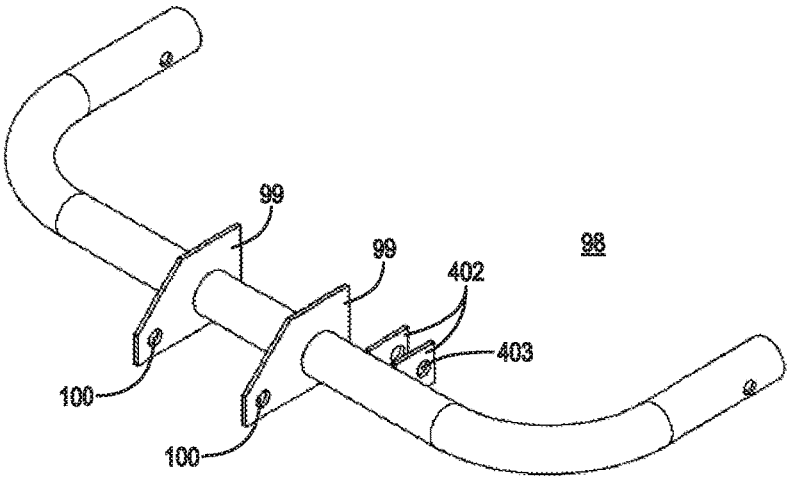
FIG. 35 is a perspective view of the modified C-shaped bar as in FIGS. 33-34.

Referring now to the drawings, in which like numerals are used to designate like or corresponding parts throughout the various figures, FIGS. 1-12 and 15-24 illustrate a first embodiment of the present invention; FIGS. 13-14 illustrate a second embodiment wherein a preferred chair back frame pivot mechanism is disclosed; FIGS. 25-30 illustrate another preferred chair back frame pivot mechanism embodiment; FIGS. 31-32 illustrate an alternative chair back frame actuator mechanism connection, FIGS. 33-35 illustrate another alternative chair back frame actuator connection, and FIGS. 36-41 illustrate another embodiment in which an independently adjustable chair footrest is provided. Referring first to FIG. 1, there is shown a perspective view of an embodiment of chair 20 of the invention in a reclined position, with the right arm frame, from the point of view of a chair occupant, and all of the upholstery removed to illustrate the components of the invention underneath. Chair 20 is comprised of a lift frame or assembly 22, shown in greater detail in FIGS. 2-3, and a chair assembly 23 which is attached to lift frame or assembly 22. Chair assembly 23 generally includes seat frame 24, back frame 26, leg or footrest 27, pair of arm frames 28, only one which is shown in FIG. 1, and linkage mechanisms 104. It will be understood that arm frames 28 of chair assembly 23 are usually of a wooden construction and are overall conventional, and one possible embodiment of the wooden chair frame attached to lift frame 22 is shown in FIGS. 22 and 23. As shown in FIGS. 2-3, lift frame 22 includes base frame 32, which is comprised of a rear crossbar 34, spaced apart parallel bars 35 and 36 connected to and extending forwardly from rear crossbar 34, and brace 37 spaced apart from rear crossbar 34 and connecting between bars 35 and 36. Forward ends 38 and 39 of parallel bars 35 and 36 curve outwardly towards the perimeter of the chair, essentially matching the ends of crossbar 34 so that base frame 32 forms a stable base or floor support for lift frame 22 and chair assembly 23 when it is in a raised or lift position, a normal seated position, or when it is in any number of reclined positions. Foot members (not shown) adjustable or unadjustable and usually padded in some manner may also be attached to the underside of rear crossbar 34 and on the forward ends 38 and 39 of parallel bars 35 and 36, or at any other desired location on base frame 32.

Also connected to parallel bars 35 and 36 near rear crossbar 34 are large brackets 42 and 43, respectively, each having apertures 44, 45, and 46 therein to facilitate pivotable attachment to the ends of U-shaped bar member 48 and straight bars 50-51. The ends of U-shaped bar 48 are pivotably connected by pins or pintles 47 such as clevis pins extending through apertures 44 in brackets 42 and 43 and corresponding aligned apertures in U-shaped bar 48, which pins may be held in place by a cotter pin or the like passed through an aperture in the end of the clevis pin. Further, straight bar 50 is connected to bracket 42 by a similar pin or pintle extending through aperture 46 and matching apertures in bar 50, while identical straight bar 51 is similarly connected by another pin or pintle extending through aperture 46 in bracket 43 and matching apertures in bar 51. If it is desired to change the angle of the lift position of the chair slightly, bars 50 and 51 could be secured in apertures 45 rather than apertures 46. Identical short reinforcing links (not shown) pivotably connect the upper ends of bars 50 and 51 to U-shaped bar 48 via pins or pintles 57 and 58 extending through apertures in such bars 48 and 50-51, respectively. Such double bar structure gives lift assembly 22 added strength and integrity so that it is sufficiently strong to support the maximum weight of the chair frame plus an occupant of the chair over an extended period of use.

Also pivotably connected to bars 48 and 50-51 on the side opposite links 54 and 56 via pins 57 and 58, respectively, is chair frame support structure 60. Chair frame support structure 60 is comprised of similar outwardly facing C-shaped bar sections 62 and 63 which are connected together by welding to third downwardly facing C-shaped section 64 situated at a right angle to sections 62 and 63. In addition, square bar sections or braces 65 are secured by welding adjacent the connection points of bar sections 62 and 63 and C-shaped section 64 through which the apertures for receiving pins 57 are provided, and serve as strengthening members for support structure 60. The ends of C-shaped bar sections 62 and 63 are secured to the underside of bottom pieces 110 of the arm frames 28 (shown in FIGS. 22 and 23) of the chair assembly 23 via screws or the like extending through apertures 66 and 67 in such bar sections. Rear crossbar 34, bars 35 and 36, brace 37, C-shaped bar 48, straight bars 50 and 51, C-shaped sections 62, 63, and 64 of chair frame support structure 60, and brace 65 are all preferably made of hollow rectangular steel bars that are welded together where appropriate. The pins or pintles, as well as brackets 42 and 43, and brackets 72, 78, and 80 (discussed below) are also preferably made of steel and welded to the steel bar structures as appropriate.

Connected spaced from the edges of rear crossbar 34, and preferably between parallel bars 35 and 36, is small bracket 72, to which motor or actuator 74 is pivotably attached by a pin or pintle. Actuator 74 may be any type of actuator including but not limited to electric, gas, and hydraulic actuators. A preferred actuator is an electric motor that relatively rotates an internally threaded sleeve 76 and an externally threaded spindle 75 received therein to increase and decrease their combined overall length, and to thereby adjust the position of objects connected to the end of such threaded sleeve and spindle arrangement. Neither such internal nor exterior threads are visible, but will be understood to be conventional in the art. Suitable actuators are the Omega-drive™ linear actuators commercially available from OkinGmbH & Co. KG located in Gummersbach, Germany, model numbers OS2-SW-394-212 and OZ-SW-330-181.

The outer end of externally threaded spindle 76 is adapted to be pivotably secured to L-shaped bracket or bell crank 78 at a central position by a pin or pintle 79 which is passed through matching apertures in the bracket and in the end of spindle 76. L-bracket 78 is in turn pivotably connected on its downwardly extending flange to small bracket 80, which bracket is secured extending downwardly from C-bar section 64 of chair frame support structure 60 by pin or pintle 82 extending through aligned apertures in L-bracket 78 and small bracket 80. Brackets 72 on crossbar 34 and 80 on chair frame support structure 60 are aligned so that the actuator mechanism extends between such brackets more or less in parallel with bars 50 and 51.

Figure 4:
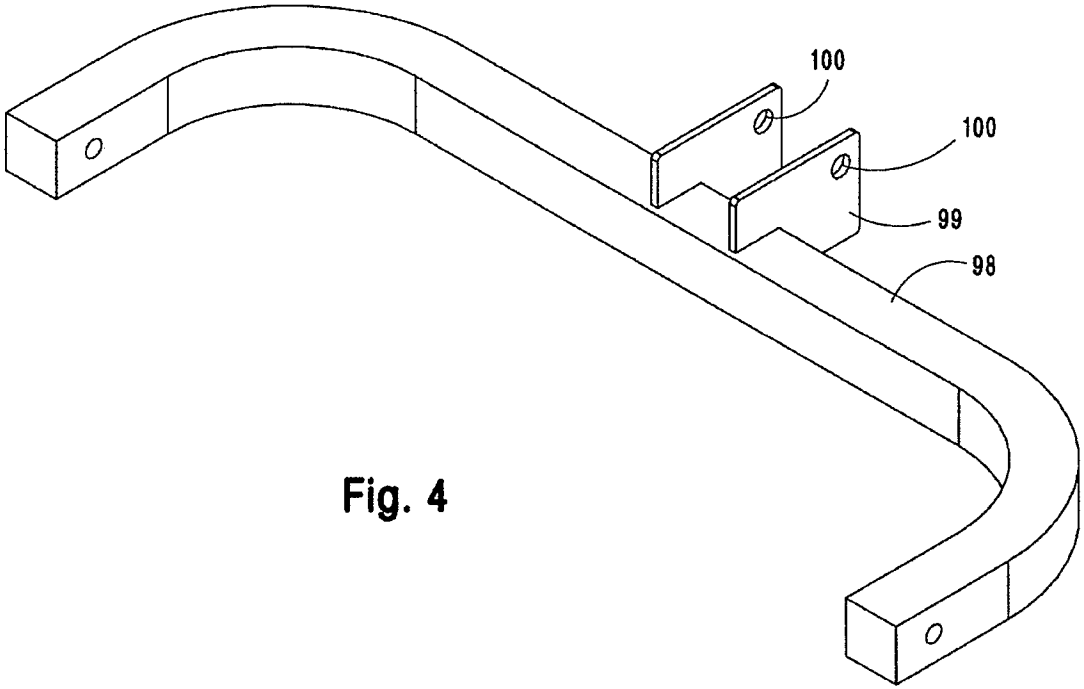
FIG. 4 is an isometric view of the C-shaped bar for pivotably connecting the seat frame and the recliner motor or actuator assembly.

Referring again to FIG. 1, as well as FIGS. 7-10 and 13-21, seat frame 24, back frame 26, and footrest 27, all preferably made of wood, are connected to lift frame assembly 22 as follows. Seat frame 24 is comprised of front member 90, rear member 91, and side members 92 and 93, which members are stapled, nailed, or otherwise secured together such as by threaded fasteners or the like to form a rectangular frame or separate frames connected together. The underside of side members 92 and 93 is tapered toward front member 90 at 94 in the present embodiment to allow sufficient room for recliner linkage mechanisms 104, shown detached from chair 20 in FIGS. 5 and 6, although this is not required in other embodiments. Recliner linkage mechanisms 104 pivotably connect the seat frame 24, back frame 26, and footrest 27 together, as described below, as well as to chair frame 28, resulting in an interconnected whole mechanism. In addition, C-shaped bar 98, shown attached to seat frame 24 in FIG. 1 and detailed in FIG. 4, is pivotably connected extending between side members 92 and 93 of seat frame 24 approximately one-third of the way from front member 90. Bracket 99 is connected by welding to C-shaped bar 98 (see FIG. 4) at a position aligned with L-shaped bracket or bell crank 78, with apertures 100 in bell crank 78 being aligned with apertures 101 in L-bracket 78 (see FIGS. 2 and 3), and being pivotably connected by a pin or pintle (not shown) such that expansion lengthening or shortening of actuator 74 is transmitted through bell crank to C shaped bar 98 and hence to the seat structure 24.

Figure 5:
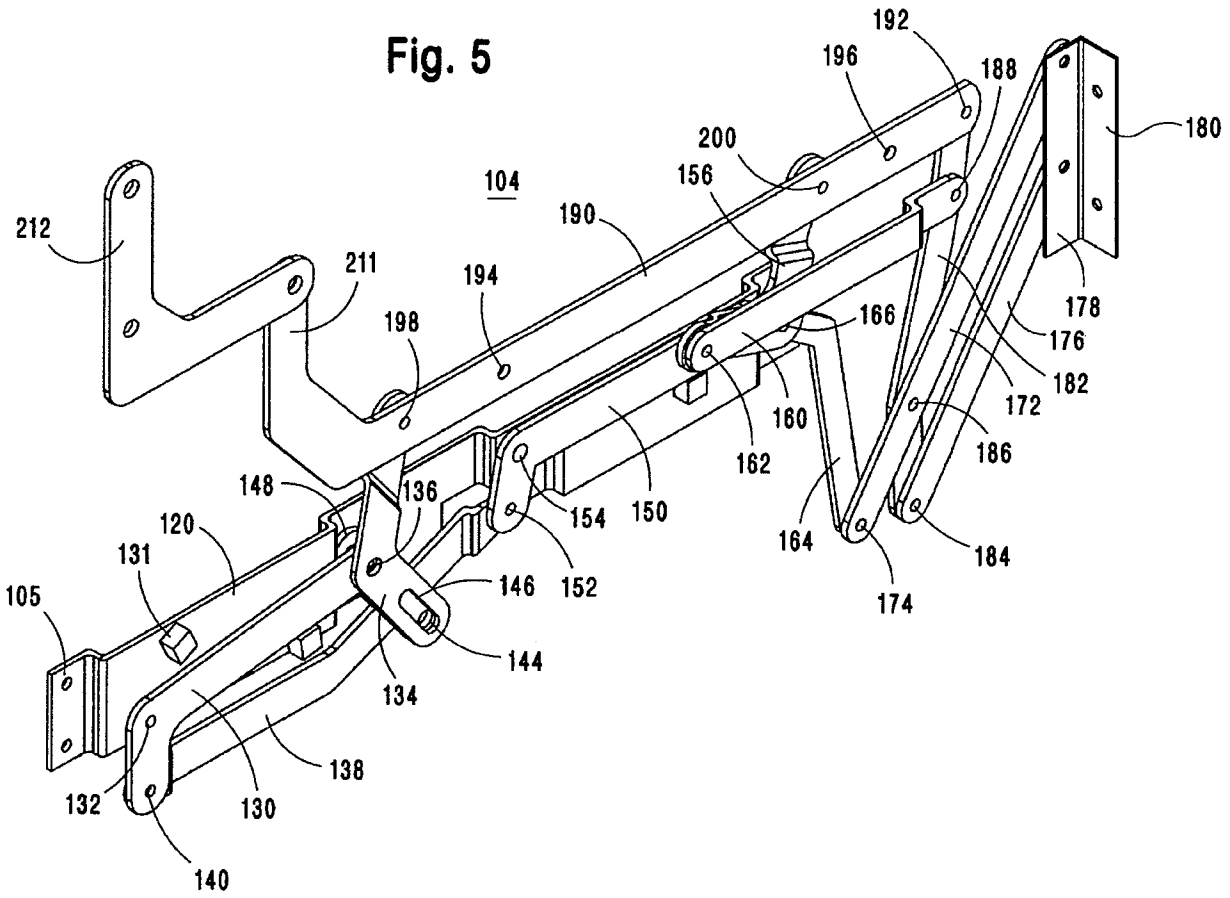
FIG. 5 is an isometric view of the recliner mechanism of the chair in a retracted position.
Figure 6:
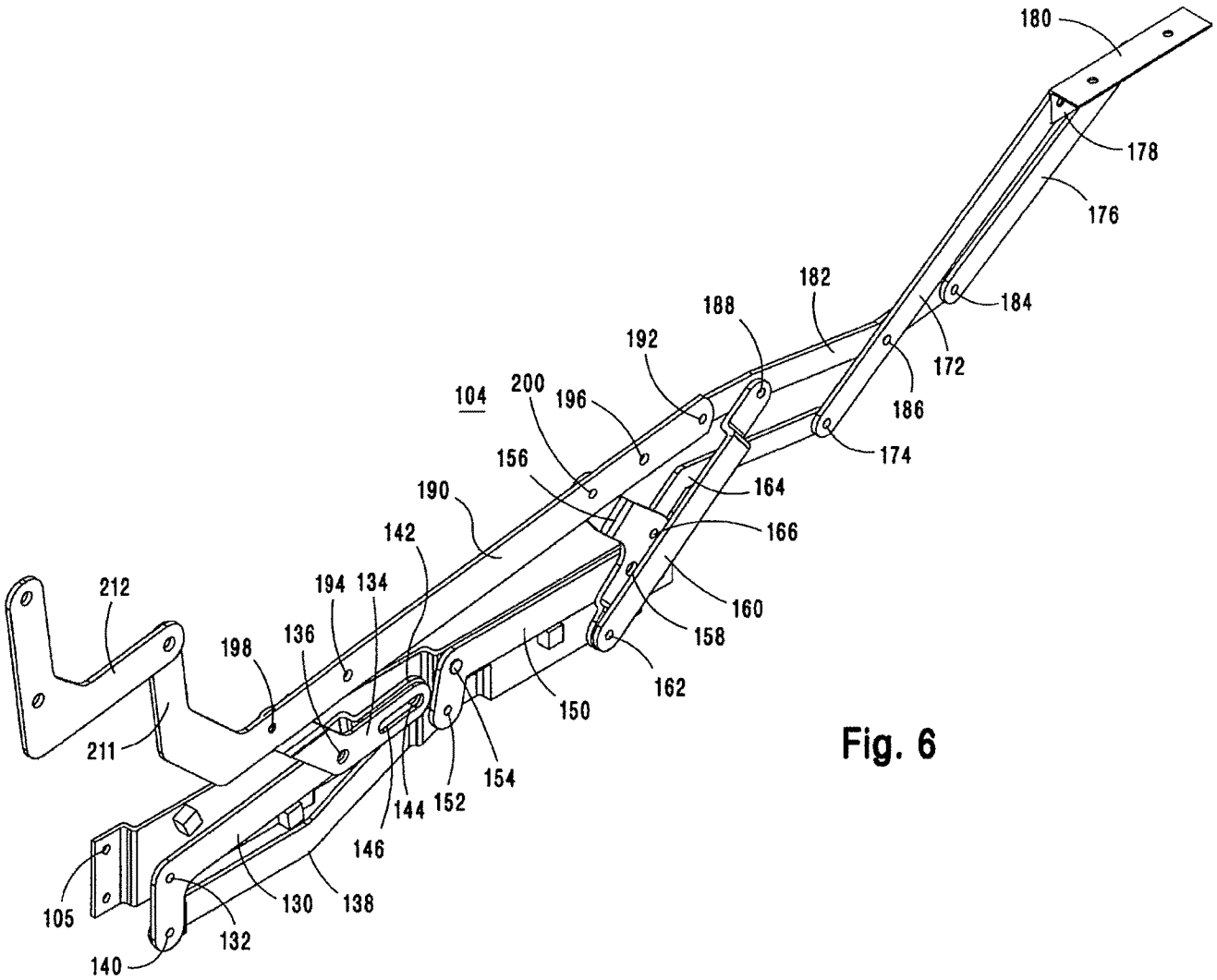
FIG. 6 is an isometric view of the recliner mechanism of the chair in an extended position.
Figure 7:
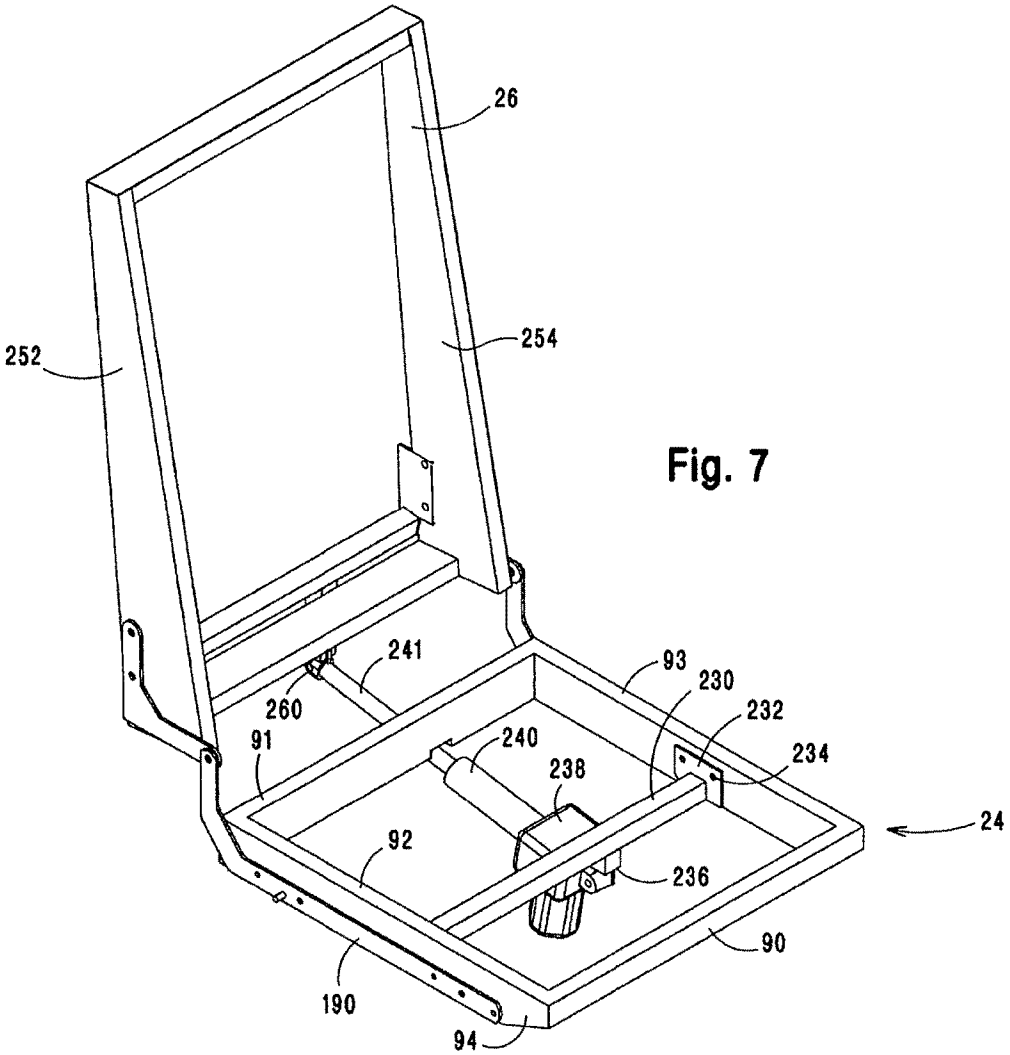
FIG. 7 is an isometric view from the left front showing the seat frame and back frame portions of the chair of the invention with the seat back motor or actuator connected and with the back frame in an upright position.

The details of recliner linkage mechanisms 104 will now be described with particular reference to FIGS. 5-6, which illustrate the mechanism in a retracted and expanded position, respectively. It will be understood that the recliner mechanism shown in FIGS. 5-6 is designed to be placed on the left side of the chair, or the right side of chair 20 when viewed from the front, and further that the right side or the left side recliner mechanism when viewed from the front is comprised of identical operative parts arranged in mirror image. It will also be understood that the present invention may be used except where specifically indicated with other recliner mechanisms known in the prior art, and the invention is not meant to be limited to use with the described recliner mechanism.

FIG. 5 illustrates recliner mechanism 104 in a retracted position, while FIG. 6 illustrates recliner mechanism 104 in an expanded position. Before recliner mechanism 104 is attached to chair 20, however, as shown in FIGS. 22 and 23, arm frames 28 may be operatively secured to lift assembly 22. More particularly, each arm frame 28 has a bottom side or surface 110, a front post 112 (also shown in FIG. 1), a rear post 114, an arm rest 116 extending between said front and rear posts, and side section 118 which connects between bottom section 110, front post 112, and rear post 114. Each arm frame 28 is secured to one of the C-shaped bar sections 62 and 63 comprising part of the lift frame or assembly 22, so that when the lift assembly is activated, the arm frames 28 along with the rest of chair assembly 23 are lifted upwardly and pivoted or tilted forwardly. More particularly, in the present embodiment, apertures 66 and 67 are provided in C-shaped bar sections 62 and 63 (see FIGS. 2-3) through which apertures 66 and 67 screws or other connectors are passed directly into the underside of each arm frame bottom section 110. Recliner mechanisms 104 are then secured to the inner surfaces of side sections 118 of arm frames 28 as described below.

Referring still to FIGS. 1, 22 and 23, recliner mechanism 104 includes an elongated arm frame connector plate 120 that is secured preferably by bolts or screws to the inner surface 122 of side section 118 of arm frame 28 through several apertures 105 on the ends and middle section of plate 120. A spacer block, not shown, may be provided between connector plate 120 and inner surface 122 of arm frame side section 118 to allow for use of slightly different sized frames. In addition, depending on the desired angle of the recliner mechanisms 104 with respect to the seat frame 28, recliner mechanism 104 may be attached to the seat frame 28 at a slight angle. Referring also now to FIGS. 5 and 6, L-shaped link 130 is pivotably connected at 132 to arm frame connector plate 120 near the rearward end of such plate, and is also pivotably connected to angled link 134 at 136. The end of L-shaped link 130 remote from pivot 136 is facing downwardly in FIG. 5 and is pivotably connected to link 138 at 140. Meanwhile, link 142, a portion of which is visible in FIG. 6 behind link 134, is pivotably and slidably connected to the lower end of angled link 134 at 144 in slide 146 in link 134, while link 142 is further pivotably connected on its other end to arm frame connector plate 120 at 148 (partially visible in FIG. 5 behind link 134). Link 138 is pivotably connected to another L-shaped link 150 at 152, which L-shaped link 150 is also pivotably connected to arm frame connector plate 120 at 154 and pivotably connected to angled link 156 at 158 (visible in FIG. 6).

Angled link 156 is further pivotably connected to one end of straight link 160 at 162, and to one end of angled link 164 at 166. The other end of straight link 160 is pivotably connected to link 182 at 188, while the other end of angled link 164 is attached to the near end of footrest link 172 at 174. The far end of footrest link 172, as well as the far end of footrest link 176, are both connected to leg 178 of footrest bracket 180. The near end of footrest link 176 is connected to one end of link 182 at 184, while link 182 is further pivotably connected to footrest link 172 at 186, and, as indicated above, to straight link 160 at 188. Finally, link 182 is also pivotably connected at its rear end to seat frame connector plate 190 at 192, which plate 190, as shown FIG. 1 as well as in several of the other Figures, is bolted to the side sections 92 and 93 of seat frame 28 through apertures 194 and 196. Angled links 134 and 156 are also pivotably connected to seat frame connector plate 190 at 198 and 200, respectively, while plate 190 is also linked at its upwardly angled rear section 211 directly to L-shaped back frame connector link or bracket 212.

Figure 26:
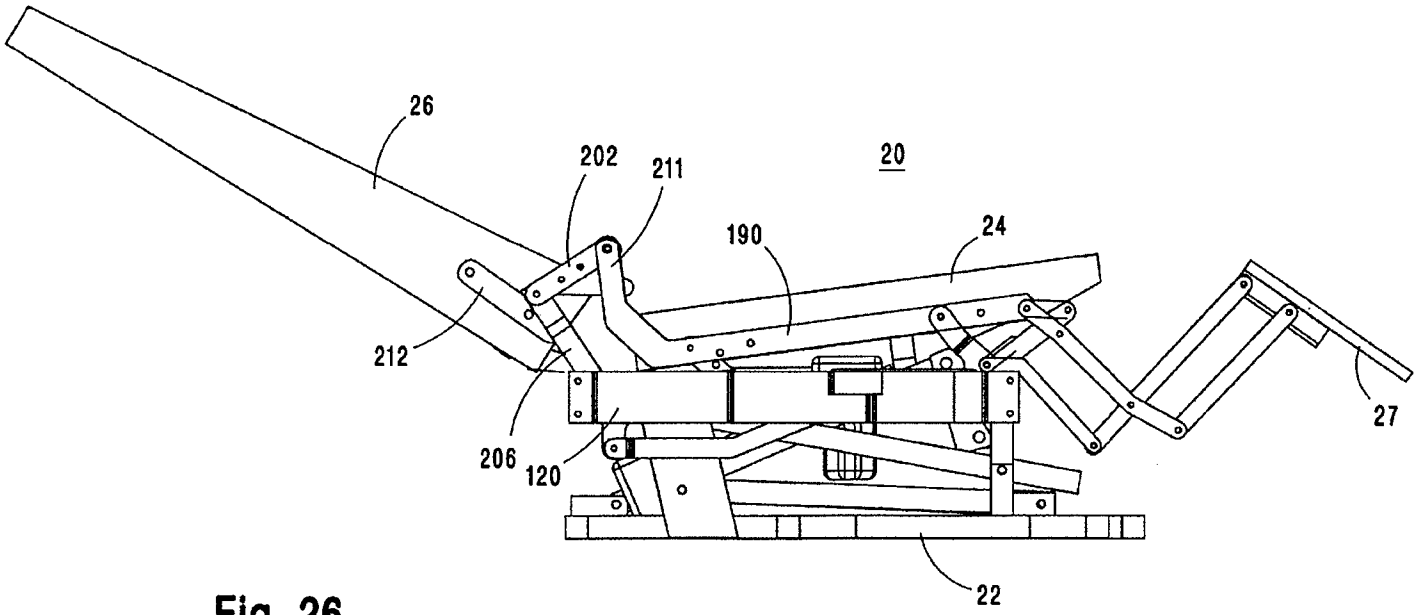
FIG. 26 is a side view of the chair shown in FIG. 25 in a zero-gravity position.
Figure 27:
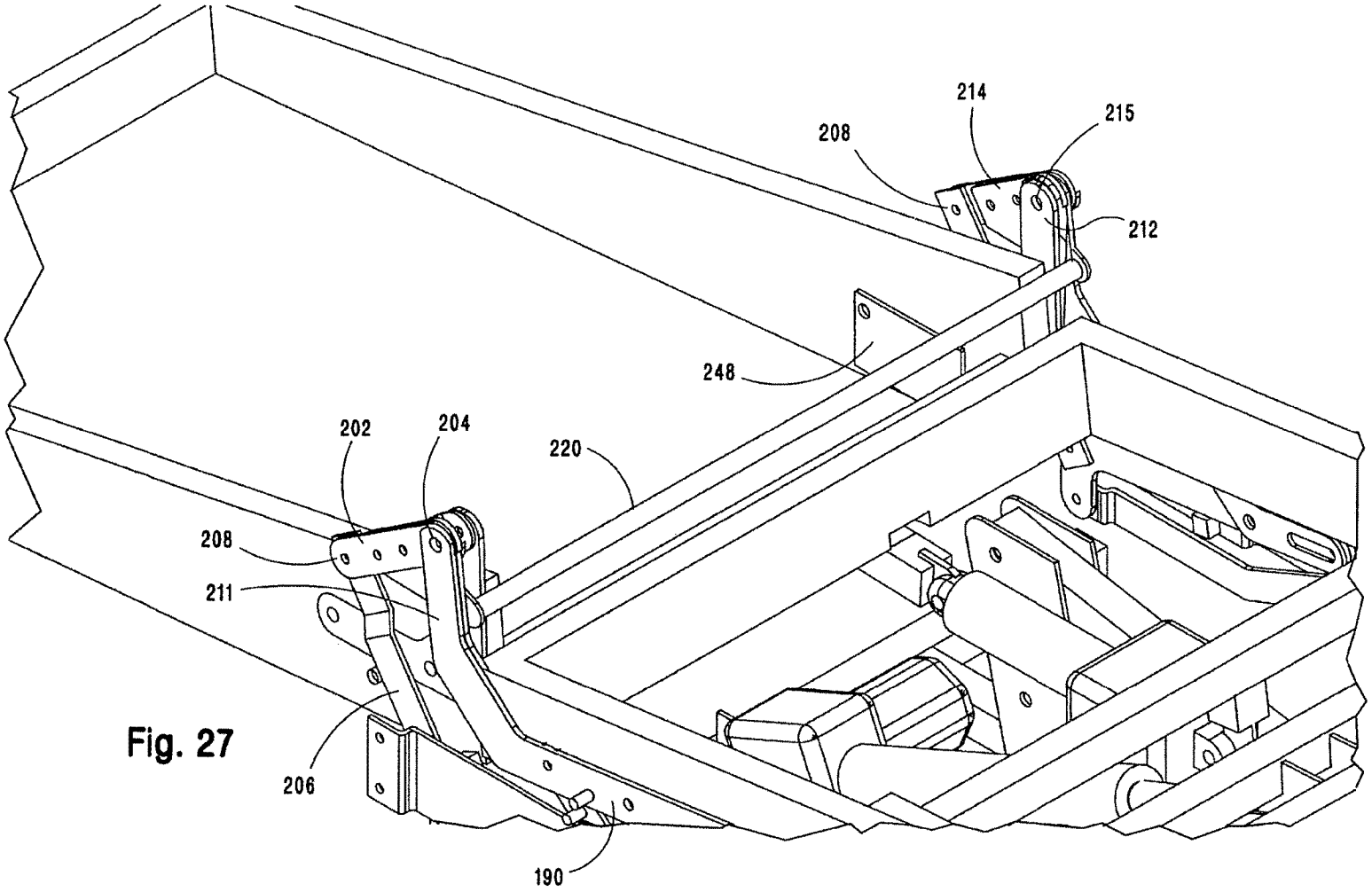
FIG. 27 is a partial front view of the back frame linkage mechanism of the chair shown in FIG. 25.
Figure 28:
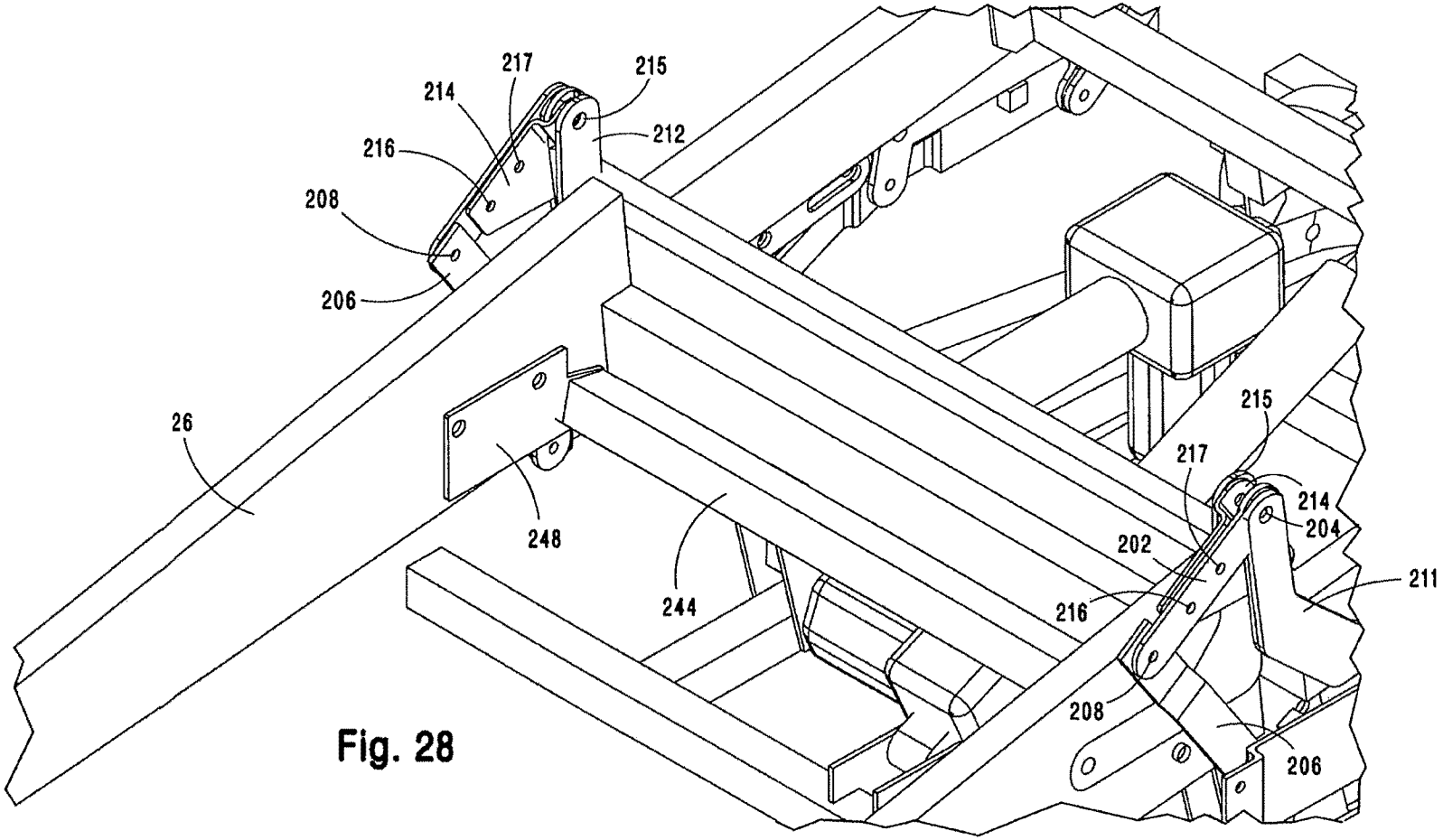
FIG. 28 is a partial rear view of the back frame linkage mechanism of the chair shown in FIGS. 25-27.

In an alternative and preferred link arrangement, shown in FIGS. 13 and 14, the upwardly bent or angled section 211 of seat frame connector plate 190 is pivotably joined to short link 202 and L-shaped link 212 at 204, while the opposite end of short link 202 is pivotably joined to straight link 206 at 208. Straight link 206 is then pivotably joined at its other end to the rearward end of L-shaped link 130 and therefore also to seat frame connector plate 120 at 132 (see FIG. 29) Such link arrangement has proven to result in a stronger and more stable connection between back frame 26, and L-shaped plate 212 and linkage mechanism 104. In a further preferred alternative link arrangement, illustrated in FIGS. 25-30, short link 202 is again, as in the embodiment shown in FIGS. 13 and 14, pivotably joined to the end of upwardly angled section 211 of seat frame connector plate 190 at 204, and short link 202 is also again joined at its opposite end to link 206 at 208. However, in such embodiment, link 202 does not also connect to L-shaped link 212, but instead, as is best illustrated in FIGS. 27 and 28, as well as in FIG. 30, another short link 214 is positioned behind link 202, which link 214 is pivotably connected to L-shaped link 212 at 215, and in addition is secured to link 202 at 216 and 217.

In addition, as is visible in FIGS. 25, 27, 29, and 30, a bar 220 is provided connecting between the lower ends of links 214. The purpose of adding links 214 and bar 220 as described and shown is to add substantially to the overall strength of such linkage arrangement. As can be seen in the FIG. 29, links 214 are each nonpivotably joined at two points 216 and 217 to links 202, as well as to each other by bar 220, and pivotably to links 212 which connect chair back 26 to such linkage system. As a result of such linkage arrangement, a rigid box-like structure or framework is essentially formed around chair back 26, which structure substantially prevents bending of any of the links that make up such mechanism from occurring, and therefore substantially increases the overall strength of the chair assembly 23. In another alternative embodiment, the arrangement shown in FIGS. 13 and 14 may be augmented with the addition of links 214 as shown in FIGS. 25-30 without, however, being connected together by crossbar 220. Such an intermediate strength mechanism may be suitable in chairs utilizing the linkage independently movable backrest arrangement of the invention wherein the additional strength provided by bar 220 is not required, such as in chairs having a lesser maximum weight limit or carrying capacity. Normally, however, it is believed that the additional strength provided by bar 220 will be most the most preferred structure.

In addition, back frame 26, as described below, will also be connected to seat frame 24 by the actuator mechanism including second motor or actuator 238. The hollow rectangular bar 244 (see FIG. 12) may have one forward side omitted such that it can fit over the lower section of the backrest, directly strengthening such lower section, and when connected through fastenings between the plates 246 and 248 with L brackets or fittings 212 forming together with cross bar 220 an essentially rigid rectangular boxed-in structure very securely reinforcing the lower end of the backrest plus the rear of the seat frame without massive structural sections on these parts, thus attaining superior strength and operation at only a minor increase in cost or weight while still retaining complete rotational movement of the seat back about a common axis and at the same time keeping the bar 220 completely out of the way with respect to pivoting of the back.

As indicated above, arm frame connector plate 120 of recliner mechanism 104 is bolted to the inner side surface 122 of side section 118 of each arm frame 28, seat frame connector plate 190 is secured to seat frame 24, and back frame connector link or bracket 212 is secured to back frame 26 via one of the alternative linkage arrangements just described, thereby joining the seat frame 24, back frame 26, and footrest 27 together with arm frames 28 and forming chair assembly 23. The arrangement of the links of recliner mechanism 104 further allow the back frame 26 to pivot independent of the footrest 27 and seat frame 26. In addition, as will now be described with particular reference to in FIGS. 7-12, which are various perspective views of just the back and seat frame portions of chair 20, which frame portions may be joined together by the basic linkage arrangement shown in FIGS. 7-10, the alternative arrangement shown in FIGS. 13-14, or the second alternative arrangement shown in FIGS. 25-30, or the intermediate further alternative arrangement described above. In any case, attached generally in the vicinity of C-shaped bar 98 (see FIG. 4) extending between first and second side frame members 92 and 93 of seat frame 24 is seat frame motor or actuator attaching bar 230, which bar is preferably comprised of a hollow rectangular steel bar. Bar 230 is shown in perspective view in FIG. 11. Welded to the ends of bar 230 are plates 231 and 232 having apertures 234 for securing by bolts, screws, or the like bar 230 to seat frame side members 92 and 93.

Figure 8:
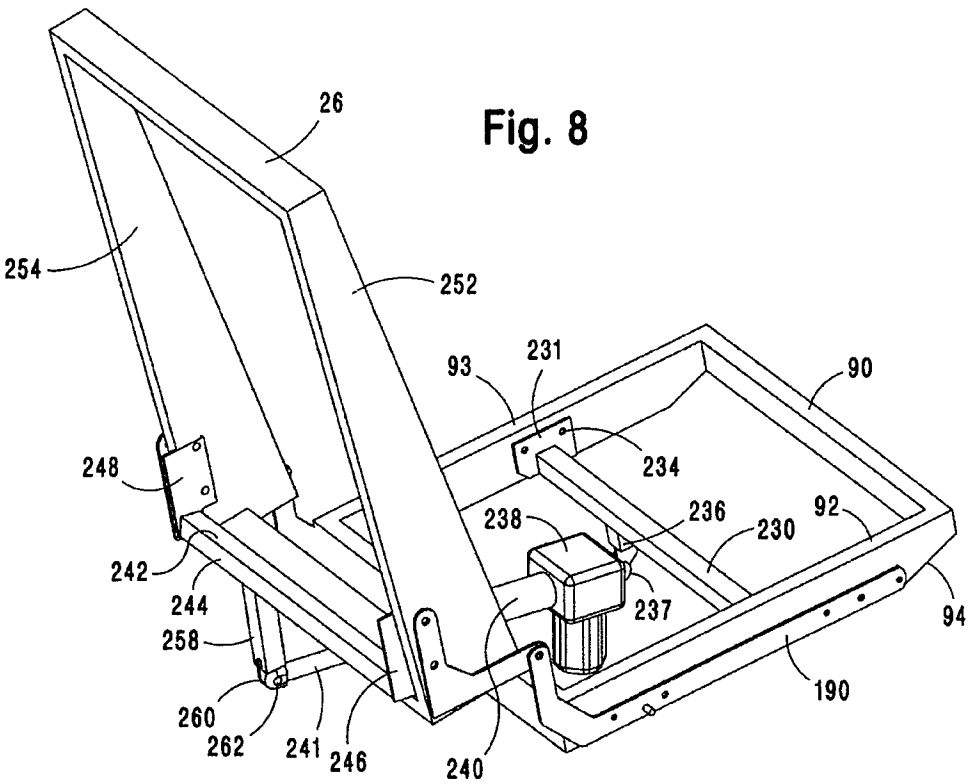
FIG. 8 is an isometric view from the right rear showing the seat frame and back frame portions of the chair of the invention with the seat back motor or actuator connected and with the back frame in an upright position as shown in FIG. 7.
Figure 9:
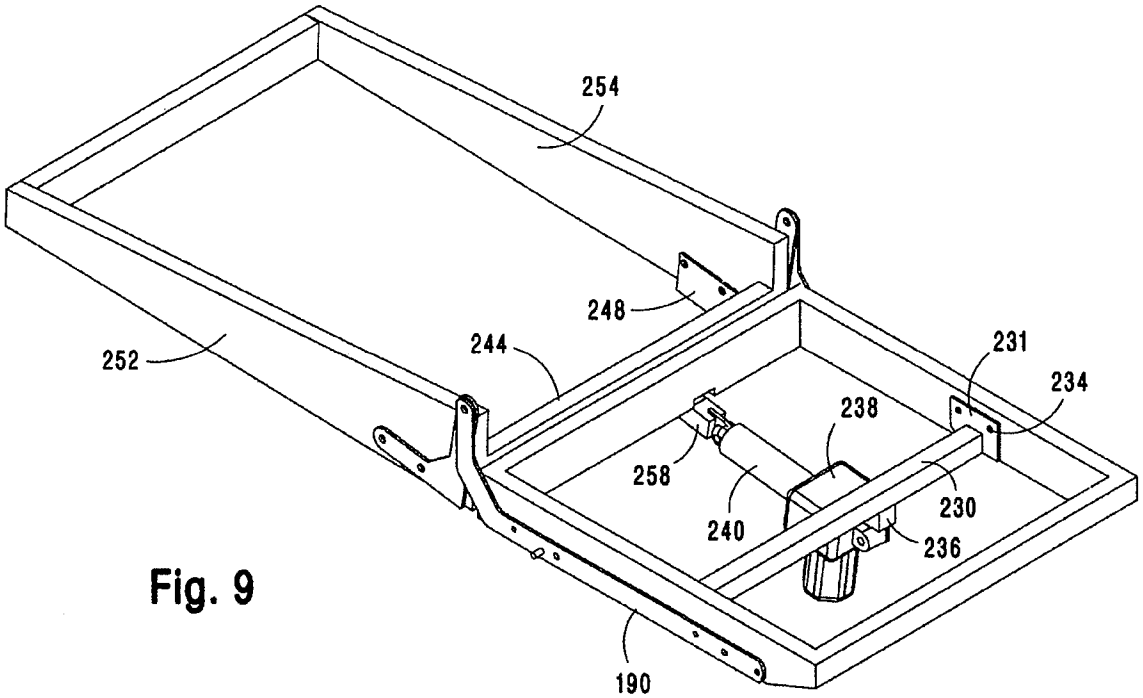
FIG. 9 is an isometric view from the left front showing the seat frame and back frame portions of the chair of the invention with the seat back motor or actuator connected and with the back frame in a reclined position.
Figure 10:
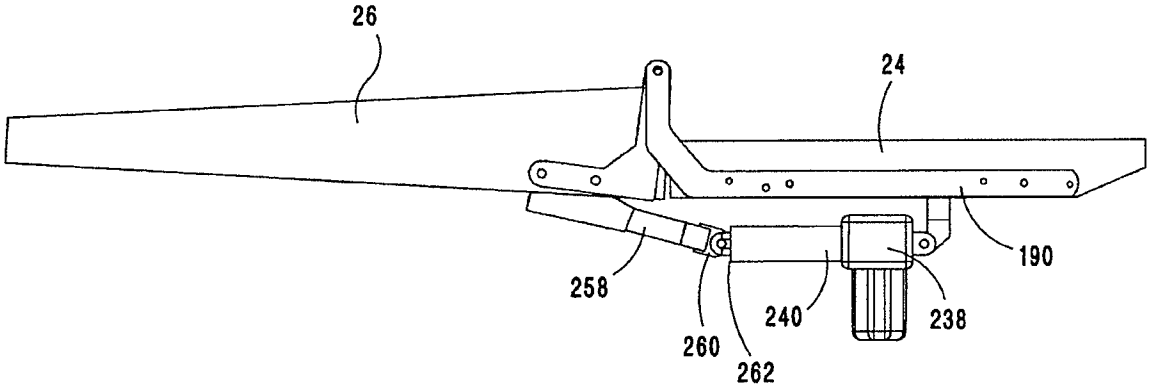
FIG. 10 is a side view showing the seat frame and back frame portions of the chair of the invention with the seat back motor or actuator connected and with the back frame in a reclined position.
Figure 11:
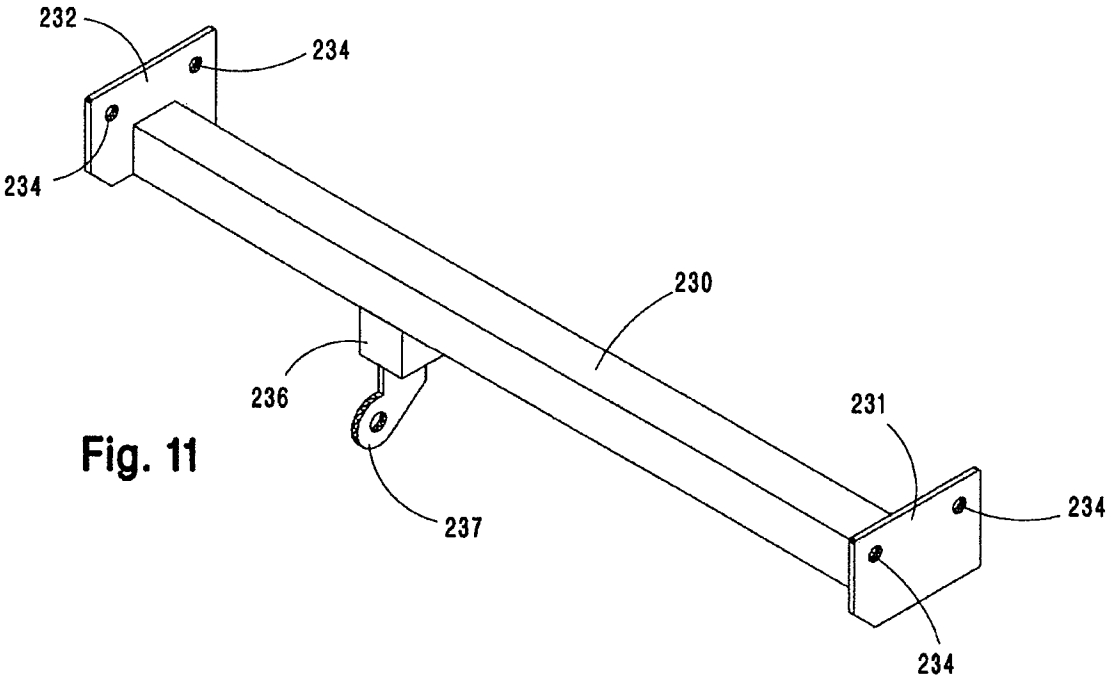
FIG. 11 is an isometric view of the bar for pivotably connecting the chair back motor or actuator assembly to the seat frame.
Figure 12:
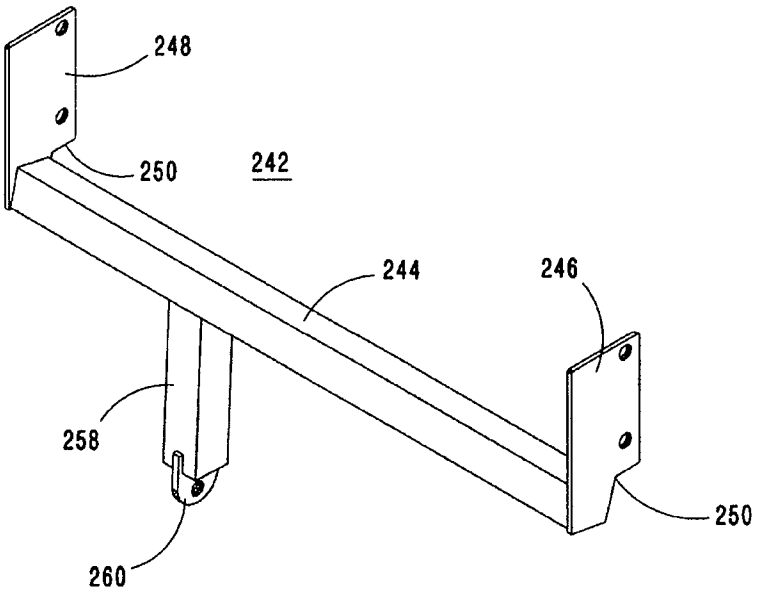
FIG. 12 is an isometric view of the back frame attaching bar for pivotably connecting the seat back motor or actuator to the seat back.

In addition, attached extending downwardly from bar 230, also preferably by welding, is connector 236 having ring-shaped aperture 237 to which seat back motor or actuator 238 is pivotably connected by a pin or the like (see FIGS. 7-10). Connector 236 is preferably situated slightly to one side of bar 230 so that motor or actuator 238 can lie or rest side-by-side with motor or actuator 74 described above, which motor is also slightly offset. Seat frame motor or actuator 238 is similar to footrest and lift motor or actuator 74 in that it also typically may be an electric motor that relatively rotates an internally threaded sleeve 240 and an externally threaded spindle 241 received therein to increase and decrease their combined overall length. The opposite [outer] end of spindle 241 is pivotably secured to back frame 26 via seat back motor attaching bar 242. Bar 242 is shown in perspective view in FIG. 12 and is preferably comprised of hollow rectangular steel bar 244 having plates 246 and 248 welded to its ends, the plates further having cutout sections 250 so that they can be secured along the inner sides of side sections 252 and 254 of back frame 26 as shown in FIGS. 8 and 9. Preferably, plate 246 is bolted or otherwise secured to side section 252 in combination with L-shaped back frame connector link 212 also on side section 252, while plate 248 is similarly bolted to side section 254 in combination with L-shaped back frame connector link 212 also on side section 254. Preferably attached by welding extending downwardly from bar 242 is short extension bar member 258, having ring 260 secured to the lower end of bar 258, so that the outer end of externally threaded spindle 241 may be pivotably secured to ring 260 via pin 262. A controller 280, shown in FIG. 24 and described in greater detail below, is then also operably connected both to lift frame and footrest motor or actuator 74 as well as seat frame motor or actuator 238 to control the overall movements of the chair frame.

Figure 15:
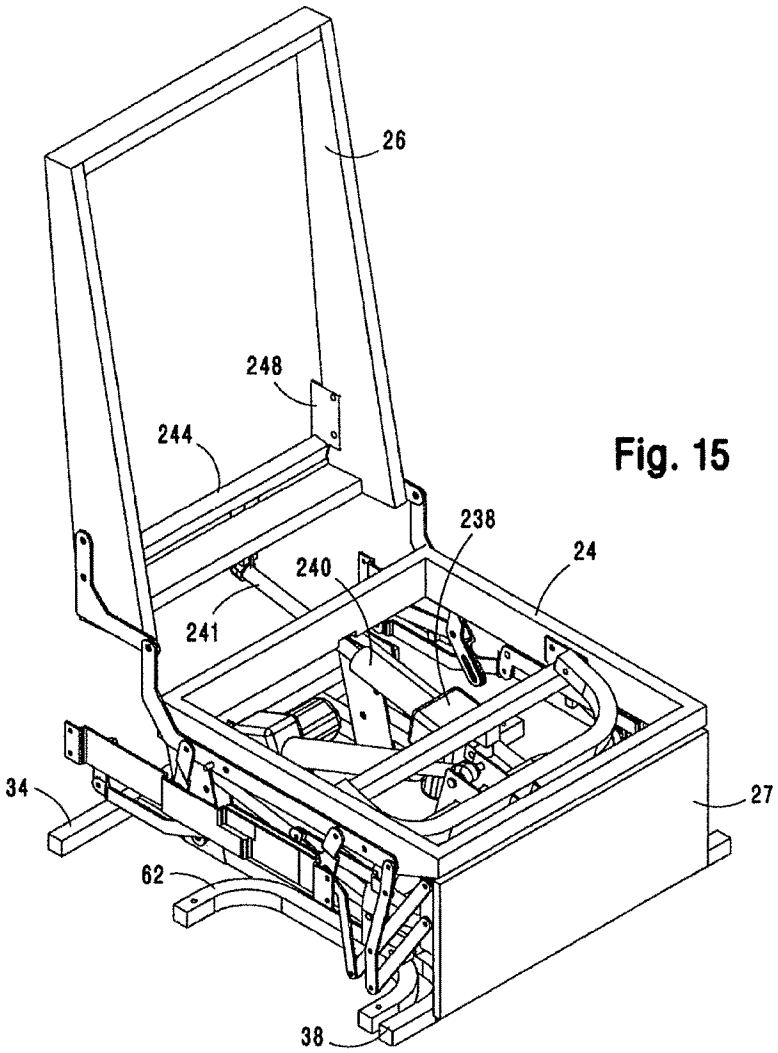
FIG. 15 is a left front perspective view of the chair of the invention in an upright or normal starting position showing the lift frame and recliner mechanism, with the chair arm frames and upholstery removed.
Figure 16:
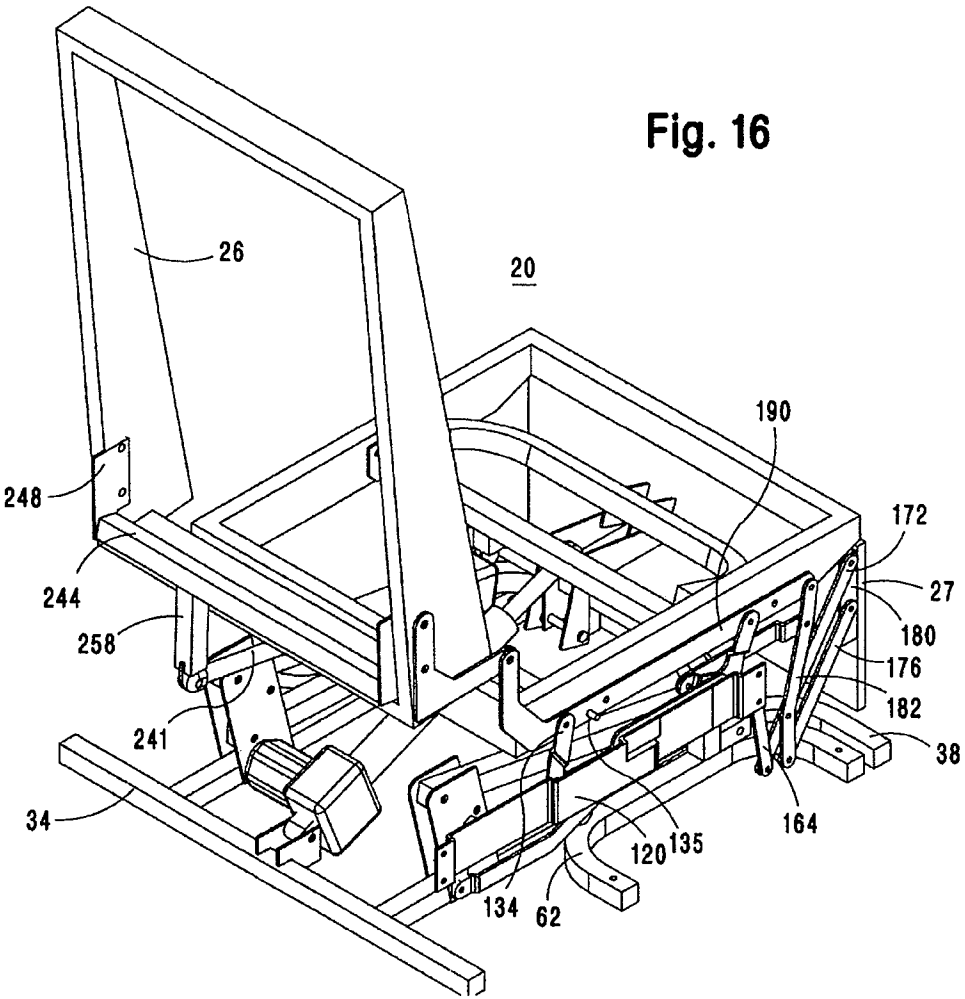
FIG. 16 is a rear perspective view of the chair of the invention in an upright or normal starting position showing the lift frame and recliner mechanism, with the chair arm frames and upholstery removed.
Figure 17:
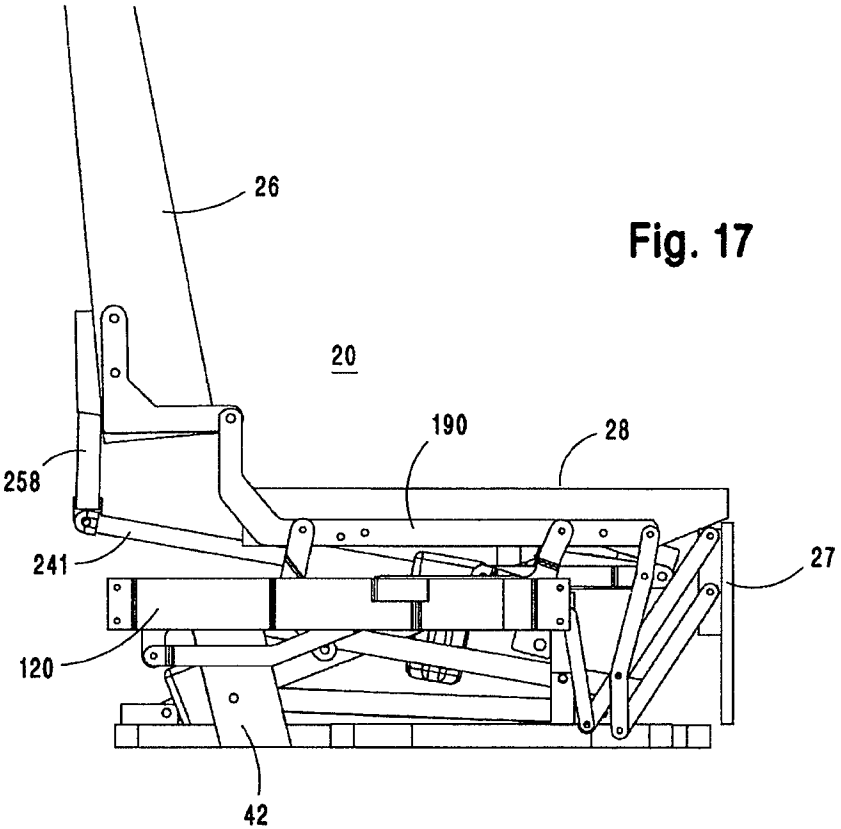
FIG. 17 is a side view of the chair of the invention in an upright or normal rest position showing the lift frame and recliner mechanism, with the arm frames and upholstery removed.

FIGS. 15-21 illustrate chair 20 of the invention in various different retracted or reclined positions. Such Figures do not include arm frames 28; however, the lift chair features of the invention are shown in FIGS. 22 and 23, where chair assembly 23 is shown supported on C-shaped pieces 62 and 63 in a lifted and forwardly tilted position. FIGS. 15-17 are front, back and side views of chair 20 in a fully upright position. When back frame 26 is in such an upright position, externally threaded spindle 241 of back actuator or motor 238 is extended from internally threaded sleeve 240. This is also evident in FIGS. 7 and 8, which show just the seat and back frame portions of the chair assembly, while in FIG. 9 as well as in FIGS. 1, 18 and 19, where back frame 26 is in a fully reclined position, internally threaded sleeve 240 in now rotated so externally threaded spindle 241 is screwed or threaded into it, so that it is effectively by retracting causing the back frame to recline. In addition, bar 258 is extending substantially directly downwardly from seat frame 26 when sleeve 240 rotates and spindle 241 is expanded out of it, and pivots forwardly when the seat frame 26 is reclined (see FIG. 19). Actuator 238 may also pivot slightly on bracket 236 attached to bar 230 to which actuator 238 is pivotably connected as the spindle 241 is moved in and out of sleeve 240 to move back frame 26. The position of bar 230 on seat frame 24 can be adjusted depending upon the particular dimensions of the chair and the position on the back frame the backframe actuator mechanism is secured to the back frame. In another embodiment, bar 230 may be modified from a straight bar to an angled bar which is secured to the seat frame between a side member of the frame and the front or rear member of the seat frame.

Figure 18:
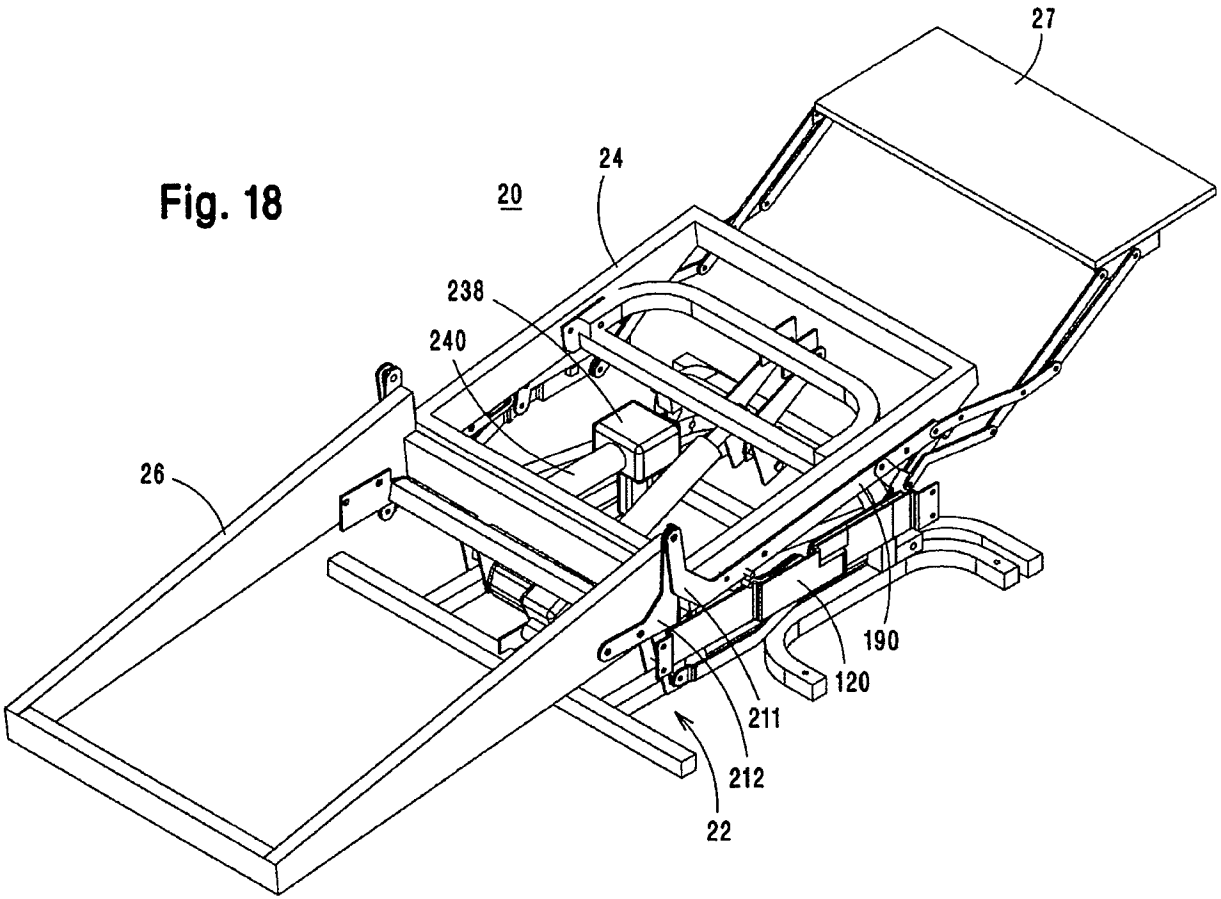
FIG. 18 is a right rear perspective view of the chair of the invention in a fully reclined position with the arm frames and the upholstery removed.
Figure 19:
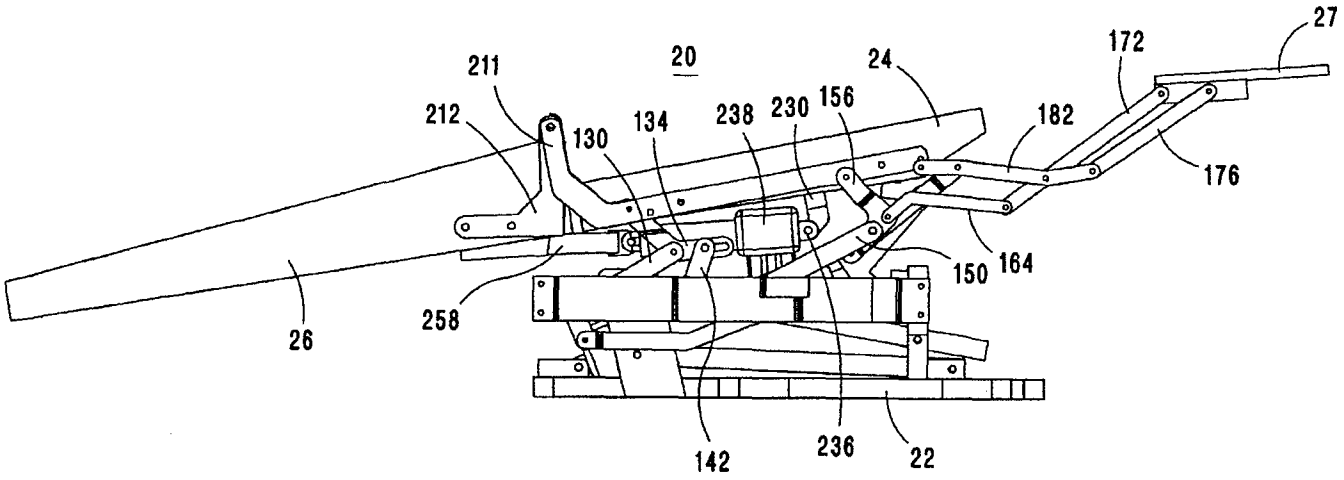
FIG. 19 is a side view of the chair of the invention in a fully reclined position with the arm frames and the upholstery removed.
Figure 24:
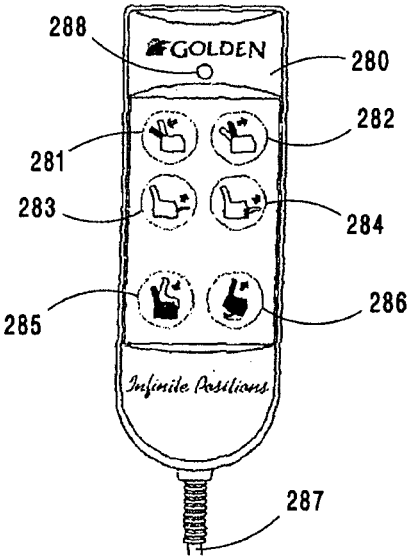
FIG. 24 is a plan view of a hand operated button type electrical controller for operation of the chair of the invention.
Figure 25:
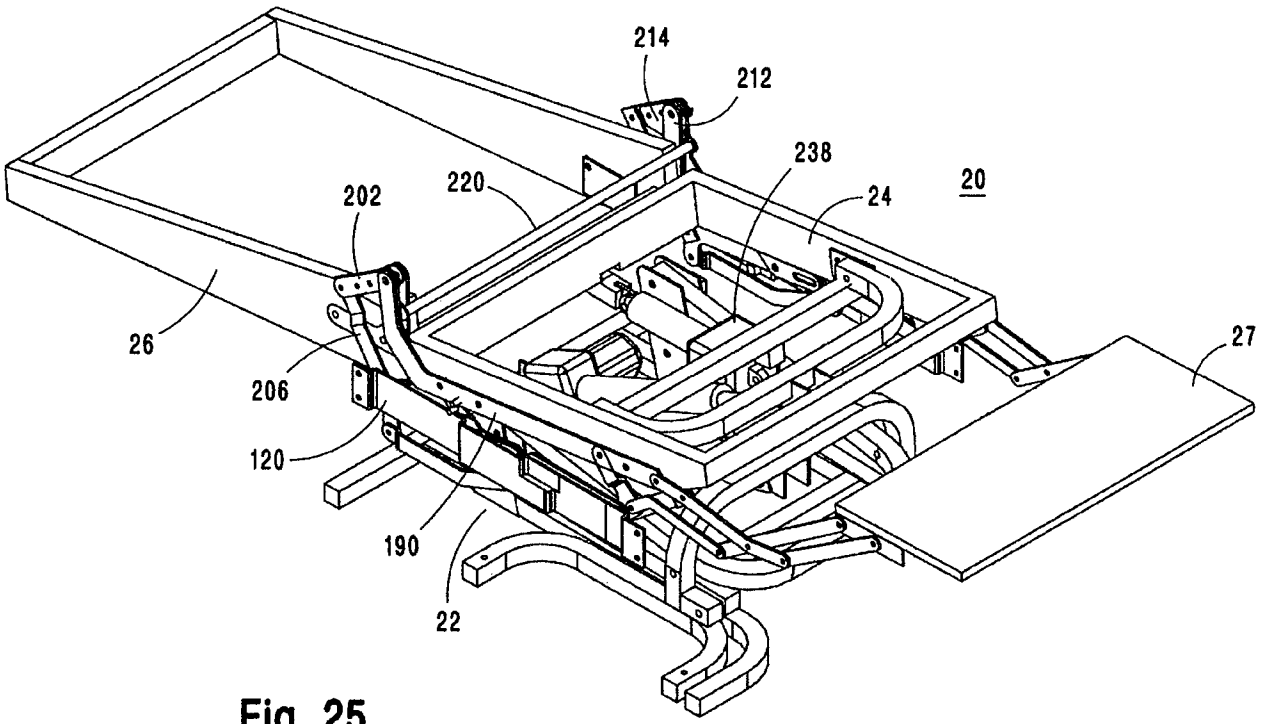
FIG. 25 is a front perspective view of another alternative embodiment of the chair of the invention.

In addition, C-shaped bar sections 62 and 63 are supporting chair 20 or act to support the chair on the ground surface in addition to rear crossbar 34 and bars 38 and 39. Recliner mechanism 104 is also in retracted position, with footrest 27 inclined substantially vertical in relation to the ground surface and footrest links 164, 172, 176, and 182, which are connected in a scissors-like or so-called pantograph arrangement, being pivoted so that they are substantially more vertical than horizontal. Link 134 is also pivoted downwardly from seat frame connector plate 190, away from stop 135. Finally, as best shown in FIG. 2, threaded spindle 75 is partially but not completely extended from sleeve 76 when footrest 27 is completely retracted. When controller 280, shown in FIG. 24, is used to activate motor 74 to move the chair from an upright position shown in FIGS. 15-17 to a reclined position such as shown in FIGS. 1, 18, and 19, spindle 75 is retracted in sleeve 76, while L-shaped bracket or bell crank 78 is pulled rearwardly along with spindle 75 by pivoting on pin 82 securing bracket 78 to bracket 80 on C-shaped section 64 of lift assembly 60. L-shaped bracket 78 also pulls C-shaped bar 98, which in turn is connected to seat frame 24 and also puts tension on the seat frame to be pulled rearwardly. Seat frame 24, which is pivotably mounted to arm frames 28 by recliner mechanism 104, in turn is pulled rearwardly, with links 134, 156, and 182 (as best shown in FIGS. 5 and 6) pivotably connected to seat connector plates 190 pivoting in a counterclockwise direction when viewed from arm frames 26 on pivot points 198, 200, and 192, respectively. Pivoting of link 156 also causes links 160 and 164 to pivot forwardly, which movement further causes scissors style pivoting links 172, 176, and 182 to pivot with respect to one another, forcing footrest 27 to be pushed upwardly and outwardly away from the front of chair 20 until the footrest is in a substantially horizontal position. Thus, when motor 74 is activated, seat frame 24 is pulled rearwardly and footrest 27 is pushed upwardly and outwardly. At the same time, back frame 26 and electrical motor 238, which is pivotably attached to both seat frame 24 and back frame 26, moves rearwardly along with seat frame 24. Such feature is important to the operation of the invention as a whole, since if motor 238 was mounted stationary with respect to the lift frame or in some other manner, seat frame 24 could not move rearwardly without coming into contact with and impinging against and possibly damaging motor 238 or vice versa.

At approximately the same point at which footrest 27 reaches a substantially horizontal position, link 134 will have pivoted so that it is now prevented from further pivoting by stop 135, see FIG. 16. Thus, rather than seat frame 24 being pulled further rearwardly, the force continued to be applied by motor 238 now causes links 130, 142, and 150, as well as 160 to pivot upwardly, and for pivot 144 connecting link 142 to slide 146 in link 134 to move rearwardly in such slide 146. In particular, L-shaped links 130 and 150 are pivotably linked to opposite ends of link 138, so that such links will pivot or rotate in unison. See in particular FIG. 19. Such links will pivot upwardly until bar 130 has pivoted so that it is abutting stop 131, shown in FIG. 16, at which point further upward movement is prevented and spindle 75 is arranged so that it will be substantially completely retracted into sleeve 76, and the chair will have reached a fully reclined position. At the same time, the front end of seat frame will be moving on C-bracket 98, which pivots somewhat downwardly in response to further pulling on bracket 99 by such actuator 74. Again, motor 74 will simply move upwardly along with seat frame 24, so that motor 74 remains in substantially the same position relative to seat frame 24 at all times. Furthermore, back frame 26 can be moved to any pivoted position completely independently of the position of footrest 27 and seat frame 24. This feature is illustrated by comparing FIGS. 18-19, where back frame 26 is in a completely reclined position, with FIGS. 20 and 21, where back frame 26 is in an upright position. In all of such FIGS., footrest 27 and seat frame 24 are in a fully reclined position, while back frame 26 has been pivoted into either an upright or reclined position by actuator 238 as controlled by controller 280. If desired, chair assembly 23 could be moved to a lift position, wherein lift assembly 22 is extended as shown in FIG. 3 and chair assembly 23 is lifted upwardly and tilted forwardly, while back frame 26 remains in a completely reclined position.

In FIGS. 13 and 14, a fully reclined or bed-like position is also shown, with the difference being in the arrangement of back frame 26 with respect to the linkage mechanism 104 which is stronger than the linkage shown with respect to the first embodiment of the invention. Similarly, in FIGS. 25 and 27-28, the chair with the back frame having a second alternative linkage system including stabilizing bar 220 is also in a fully reclined position. Such fully reclined position is essentially the Trendelenburg position, wherein the operator's legs are higher than his or her heart, which position is often desirable. However, the chair can also be moved to a reclining position, wherein the legs are not higher than the heart, either by not reclining the footrest mechanism all the way, or alternatively by pivoting the back frame upwardly, which will lift the occupant's torso upwardly. To return chair 20 to a non-reclined position, links 130 and 150 will pivot downwardly in a clockwise direction until they are prevented from further pivoting by stops 133 and 151, respectively. During this period, seat frame 24 and footrest 27 will be moving generally in a downward direction. Bar 98 will also pivot upwardly or forwardly as the seat frame is lowered. Once links 130 and 150 hit stops 133 and 151, respectively, the seat frame will move forwardly as the footrest 27 continues to be pulled inwardly towards chair 20 until it is again substantially vertical and seat frame 24 has returned to its original position.

Figure 20:
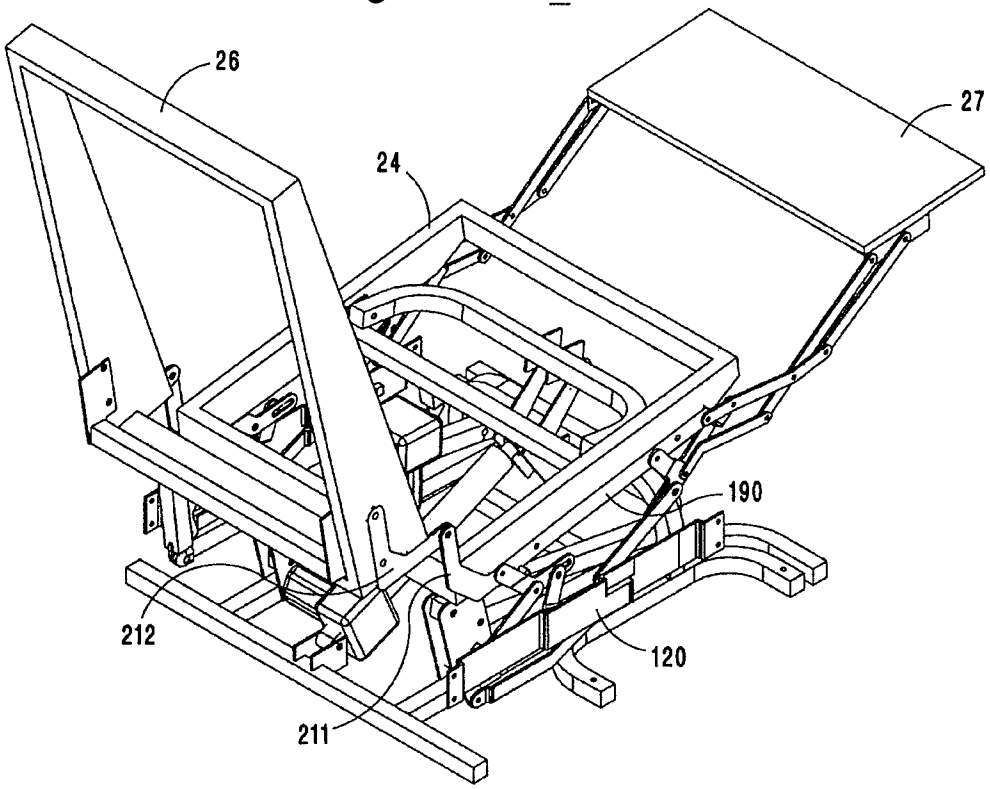
FIG. 20 is a right rear perspective view of the chair of the invention with the seat and footrest in a reclined position, but with the back frame in an upright position, with the arm frames and upholstery removed.
Figure 21:
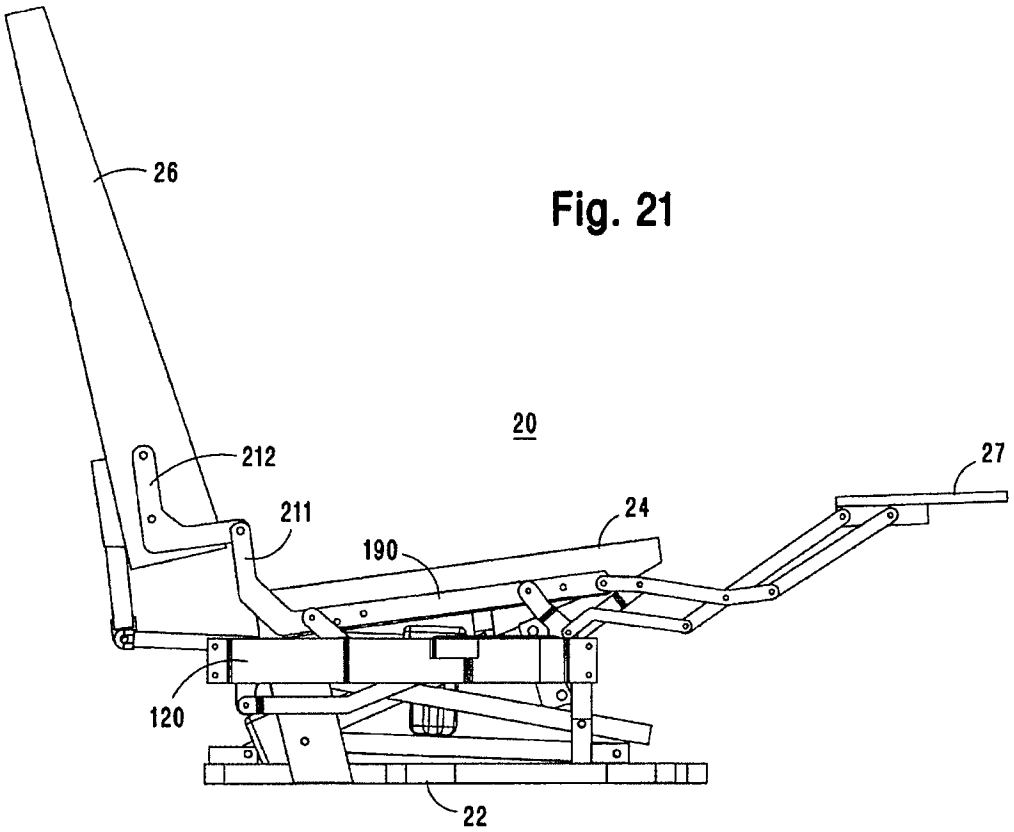
FIG. 21 is a side view or elevation of the chair of the invention with the seat and footrest in a reclined position, but with the back frame in an upright position, with the arm frames and upholstery removed.

The ability of the seat frame to pivot rearwardly with the footrest results in a significantly more maneuverable and comfortable recliner and/or lift chair design than is available in the prior art. In chairs where the seat frame does not move in relation to the footrest, the resulting orientation is often uncomfortable for most users and furthermore it cannot be augmented to meet the comfort or medical needs of individual users. For example, as shown in FIG. 19, a person lying in chair 20 will be in the so-called Trendelenburg position, which is a position where such person's legs are higher than his or her heart. For persons who do not require or desire such a position, the back frame can be moved to a position such as shown in FIG. 20. In addition, as is shown in FIG. 26, the user may pivot the chair into a so-called "zero gravity" or back relief position, which provides complete support for the user and relieves pressure from the spine. Note in particular that in FIG. 26, the footrest is not completely horizontal but is at a slight forward incline or angle.

Figure 29:
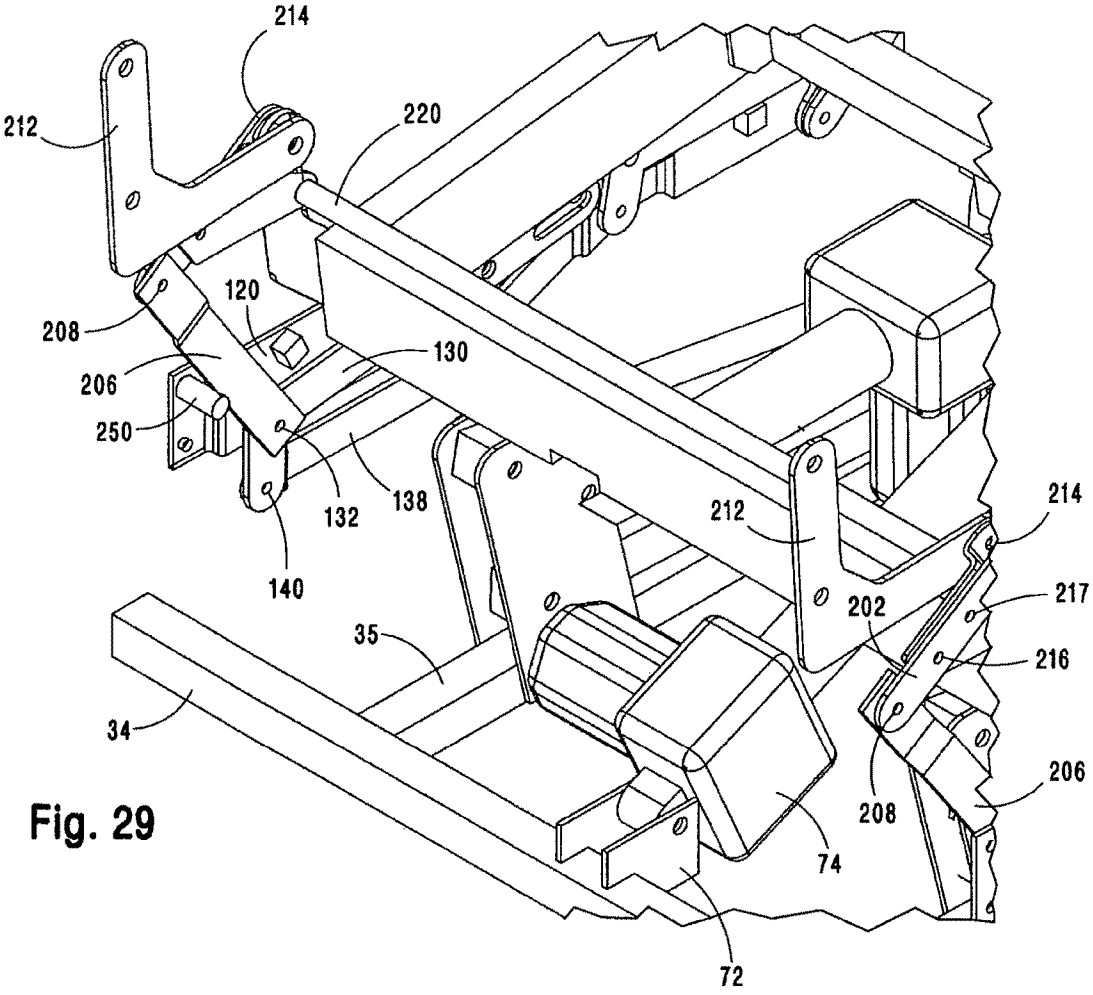
FIG. 29 is a partial rear view similar to FIG. 28 with the chair back frame removed and showing the stop means for adjusting the angle of the footrest slightly.
Figure 30:
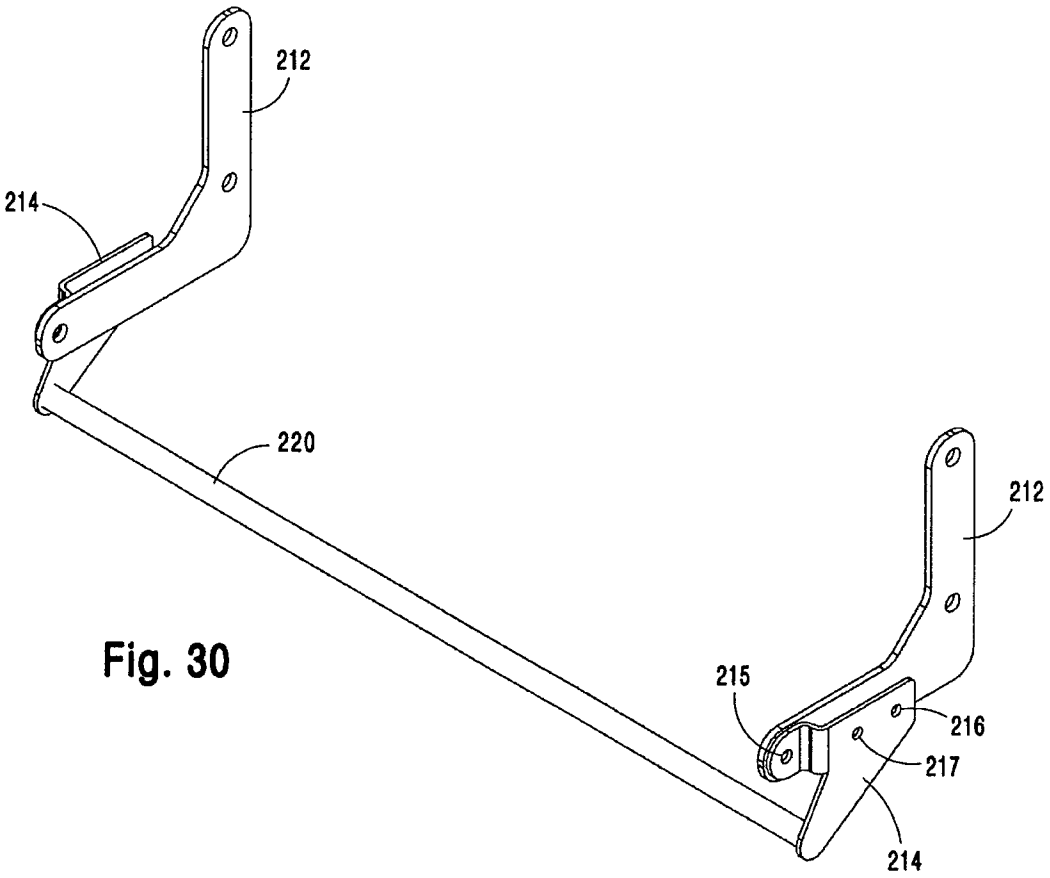
FIG. 30 is a perspective view of the improved alternative back frame linkage mechanism of the invention.

In another novel feature of the invention, the present inventors have conceived of a simple yet extremely effective means for adjusting the angle of the footrest based on the desires and needs of individual purchasers of chair 20. Normally, when the chair is being moved to a reclining position, as explained above, the footrest 27 will move upwardly and the chair seat frame 24 will move rearwardly on linkage mechanism 104 until the footrest has reached approximately a horizontal position. However, as is best shown in FIG. 29, stop 250 is positioned extending inwardly from the rear edge of seat frame connector plate 120. As a result, just before footrest 27 reaches a horizontal position, link 206 will move rearwardly into contact with stop 250, which will prevent the linkage mechanism from further rearward movement, and footrest 27 will be deployed at an angle that is slightly less than horizontal. It should be evident, therefore, that by replacing stop 250 with a similar stop having either a slightly greater or slightly reduced diameter, the angle at which footrest 27 ultimately comes to rest can be adjusted slightly. The use of stop 250 provides a simple and effective means for enabling the footrest to be slightly inclined, and so as a result chair 20 can also be adjusted so that it is in substantially a zero-gravity position, such as that shown in FIG. 26, wherein all of the weight of the chair occupant has been relieved from the spine, and the body is essentially in a stress-free position. Depending upon the physical characteristics of an individual user of chair 20, the zero-gravity position may be slightly different, and thus the ability to adjust the angle of the back frame 26 independent of the position of both the seat frame and footrest, plus the ability to slightly adjust the angle of the footrest accordingly by changing the diameter of stop 250, a more user-friendly and easily adjustable lift and recliner comprising a substantial advance in the art has resulted.

The controller 280 provided to control or activate motors 74 and 238, shown in FIG. 24, may be of a conventional type, and preferably will have separate buttons for reclining the seat back 281, moving the seat back to an upright position 282, moving the chair to a reclining position with the footrest extended 283, moving the footrest to a retracted position 284, activating the lift assembly so that the chair frame is raised and tilted forwardly 285, and for returning the lift assembly to a retracted position 286. Wire 287 connects controller 280 to the actuators, although a wireless connection may also be used if preferred. A light means 288 may also be provided to indicate activation or multiple light means could be provided to indicate modes of operation.

In addition to the previously described embodiments in which the back motor or actuator mechanism is pivotably connected to the seat frame 24 by seat frame bar 230, and more particularly with the engaging member or connector on the rear end of the housing for actuator 238 being pivotably connected to connector 236 attached to seat frame bar 230 (shown in FIG. 11) there are other possible arrangements by which the back frame actuator mechanism can be connected between the back frame and components of the chair other than seat frame bar 230 that still allow the back frame 26 to be adjusted or pivoted independent of any movement or change of position of the seat frame 24 or footrest 27. FIGS. 31-32 illustrate one such possible arrangement, in which chair 100 as in the previously described embodiments includes a lift frame or assembly 22 for supporting as shown previously a chair assembly 23 including a seat frame 24, back frame 26, leg or footrest 27, pair of arm frames 28, and mirror image linkage mechanisms 104. Lift frame 22 is connected to base frame 32 which includes a rear crossbar 34, spaced apart parallel bars 35 and 36 extending forwardly from rear crossbar 34 and having outwardly curved forward ends 38 and 39, and a front crossbar 37 connecting between bars 35 and 36. Large brackets 42 and 43 having apertures 44, 45, and 46 are connected to parallel bars 35 and 36 near rear crossbar 34, and the ends of U-shaped bar member 48 are pivotably connected to brackets 42 and 43 by pins or pintles passed through apertures 44 and matching apertures in bar member 48. In addition, straight bars 50 and 51 are pivotably connected on one end to brackets 42 and 43, also by pins or pintles 47 which are passed through aligned apertures in bars 50-51 and apertures 45 or 46 in brackets 42 and 43, respectively.

Also as previously described, a chair frame support structure 60 is provided that includes a pair of opposed outwardly facing C-shaped bar sections 62 and 63, and a third upright C-shaped section 64 which joins between bar sections 62 and 63, with a reinforcing member 65 also provided to strengthen these connections. C-shaped section 64 of chair support structure 60 is pivotably connected near its outer edges to U-shaped bar 48, and straight bars 50-51 are pivotably connected to reinforcing member 65, respectively. As previously illustrated in FIG. 22, bottom sections 110 of arm frames 28 are then secured to chair frame support sections 62 and 63. Small apertured bracket 72 is mounted to rear crossbar 34 to which a chair lift and recline actuator mechanism is attached. More particularly, the actuator mechanism includes a reversible electric motor or actuator 74 having an engaging member on the rear end of the actuator housing which is adapted to be pivotably connected to small bracket 72 by a pin or pintle. Outer tube member or sleeve 75 extends outwardly from the actuator motor housing, a spindle or rod 76 is telescopingly movable in sleeve 75 as a result of the operation of the reversible motor 74, and another engaging member is provided on the distal end of spindle or rod 76.

C-bar section 64 as well as spindle or rod 76 are both joined to bell crank 378, shown in isolation in FIG. 32. The configuration of bell crank 378 is slightly modified from previously described L-shaped bell crank 78 to have a more lineal configuration, although it will be understood that the particular configuration of the bell crank is not critical to the novelty of the invention except where specifically described. Bell crank 378 includes a pair of identical or matching spaced apart sections 380 and 381, each having a first through-aperture 382 situated near one end, a second through-aperture 384 situated near the opposite end, and a third aperture 386 situated between apertures 382 and 384. Edge 388 in a side surface of sections 380 and 381 is inwardly angled starting on the end closest to second aperture 384, forming a lip 390. Another edge 392 on the opposite side of sections 380 and 381 from edge 388 is outwardly angled starting from the end near first aperture 382.

As shown in FIG. 31, bell crank 378 is connected to upright C-shaped section 64 of chair frame support structure 60 by passing a pin or pintle through aligned apertures in small bracket 80 (see also FIG. 3) secured to C-bar section 64 and apertures 384 in sections 380 and 381 of the bell crank 378. Bell crank 378 is similarly connected to C-shaped bar 98 (as shown in FIG. 4), which as described previously is attached to seat frame 24, by passing a pin or pintle through aligned apertures 100 in bracket member 99 on C-shaped bar 98 and apertures 382 in sections 380 and 381 of bell crank 378. The engaging member on the distal end of sleeve 76 of lift/recline motor or actuator 74 is also secured to bell crank 378 by passing a pin or pintle through aligned apertures in such engaging member and apertures 386 in sections 380 and 381 of bell crank 378.

A separate back frame actuator mechanism is also provided, which is comprised of a second reversible electric motor or actuator 238 having an engaging member 239 on the rear end of the motor housing, an outer tube member or sleeve 240 which extends outwardly from the motor housing, and a spindle or rod 242 which rod is telescopingly movable in sleeve 240 as a result of the operation of the reversible motor 238 and having an engaging member 241 on its distal end. In the presently described embodiment, engaging member 239 on the rear side of the back motor housing is also connected to bell crank 378 by pin or pintle 379. which as described above with respect to attachment of spindle 76 of lift/recline actuator 74 extends through third apertures 386 of sections 380 and 381 of the bell crank 378. More particularly, engaging member 239 is spaced from the outwardly facing surface of section 281 of bell crank 378 by a spacer tube 394. Spacer 394 has a length such that engaging member 239 is aligned with the linkages for engaging member 241 on spindle 242 when connected to the back frame 26. Pin or pintle 379 thus has length sufficient for it to be passed through section 380 of bell crank 378, engaging member 77 on spindle or rod 76 of the lift/recliner actuator mechanism, section 281 of bell crank 378, spacer tube 394, and connector 239 on the motor housing for actuator 238.

The position of the seat frame is adjusted by extending and retracting spindle 76 by activation of reversible electric actuator 74, which spindle 76 is connected to bell crank 378 at the position of aligned apertures 386 in sections 380 and 381 of the bell crank 378. By securing back frame actuator 238 to bell crank 378 at the same relative position as lift/recline actuator 234, without requiring any further adjustment actuator 238 will follow or be similarly adjusted with respect to all possible positions within the range of motion of the lift/recline actuator, ranging from a lift position when spindle 76 of actuator 74 is fully extended and a fully reclined position when spindle 76 of actuator 74 is fully retracted. Thus, even though the back frame actuator mechanism it not connected directly to the seat frame 24, when connected to bell crank 378 the back frame actuator mechanism still travels with or follows the seat frame as it is moved, so that as in the previous embodiment the back frame actuator 238 will not hinder the movement of the seat frame 24 and can be used to independently adjust the angle or position of the back frame 26 irrespective and completely independent of the position of either the seat frame 24 or footrest 27. More particularly, as the chair is moved into a lift position, the seat frame is lifted forwardly and upwardly by the lift assembly, and the bell crank and C-shaped bar although connected to or comprising part of the lift assembly which is responsible for moving the seat frame, are also lifted forwardly and upwardly, in effect moving with or following the movement of the seat frame. Similarly, when the chair is moved into a reclining position, depending upon the particular recliner linkage mechanism utilized, which may be a modified standard two-way or three-way mechanism or other type of mechanism, the seat frame may be moved rearwardly, upwardly, the rear side of the back frame may be angled slightly downwardly, or a combination of movements may occur, in which case the bell crank and C-bar similarly follow or move with the seat frame. As a result, during any such movements of the chair assembly, the back frame actuator is similarly moved and therefore remains in substantially the same position with respect to the seat frame, although it will be understood that the angle of the bell crank and C-bar with respect to the seat frame will change as the chair is moved to a lift or recline position, and therefore the angle of the back frame actuator mechanism with respect to the seat frame may change slightly, although the pivotable connection of the back frame actuator on both ends will tend to keep it aligned with the seat frame as it is moved.

It will be understood that the back frame actuator mechanism could be secured to bell crank 378 in other ways than as shown in FIG. 31, for example, by adding another aperture to section 381 of the bell crank in close proximity to apertures 386 to which engaging member 239 of actuator 238 could be connected. Spacer tube 394 may also be either permanently connected to the outer surface of section 381 of bell crank 378, or alternatively may be secured in position by a threaded connection or a clamp fit when pin or pintle 379 is secured in place, as long as it does not bend or twist upon activation of actuator 238. The alternative connection arrangement of the back frame actuator mechanism to bell crank 378 just described is illustrative that the back frame actuator 238 can be connected to the lift/recline chair 100 other than directly between the seat frame 24 and back frame 26 or a separate bar member attached directly to the seat frame 24, including both bell crank 378 and bell crank 78 as shown in the previous embodiments. Since bell crank 378 directs the motion of the seat frame 24 as it is moved from an upright position to either a lift position or a fully reclined position, connecting the back frame actuator mechanism to the bell crank at the same position or close to the same position as the lift/recliner mechanism allows the back frame actuator to follow the movement of the seat frame as if it was attached directly to the seat frame. Thus, the back frame actuator mechanism will not impinge against any other components of the chair or otherwise hinder the movement of the chair as the lift/recline actuator is operated to move the chair to a lift and/or recline position, and can be used to adjust the angle of the back frame completely independent of the of the seat frame.

FIGS. 33-35 illustrate another arrangement embodiment for connecting the back frame actuator mechanism between back frame 26 and the chair assembly for enabling independent movement of the back frame 26 without regard to the particular position of the seat frame 24 and/or footrest 27. The main difference between the embodiment shown in FIGS. 31-32 and the present embodiment is that nonlinear or C-shaped bar 98, which is pivotably connected to the seat frame 24, as shown in FIG. 35 has been modified to include a second smaller bracket member 402 having aligned apertures 403, which is slightly spaced apart from bell crank-engaging bracket 99 on one side. As shown in FIGS. 33-34, engaging member 239 on the housing for back frame actuator 238 is positioned with its apertures aligned with apertures 403 in small bracket member 402, and a pin or pintle 403 is passed through these aligned apertures to pivotably secure actuator 238 to bar 98. Thus, rather than pivotably connecting the back actuator mechanism directly to the seat frame 24, or to a separate rigid or pivotable bar member or support attached to the seat frame such as bar 230, or to bell crank 378, C-shaped bar 98 can be modified to receive the back frame actuator mechanism. Since C-shaped bar 98 is pivotably connected to seat frame 24, its relative position with respect to seat frame 24 is allowed to change as the chair assembly is moved between a lift position and a reclining position using actuator 74. However, the center section of C-bar 98 pivots in a substantially arc-like or circular motion, and its actual range of movement as the lift/recline actuator 78 is operated is relatively small, so that connecting actuator 238 to bar 98 does not limit such movement. It will also be understood that bracket member 402 on C-shaped bar 98 will be aligned with the connection of engaging member 241 on actuator sleeve 242 when it is connected to the back frame linkages.

Figure 36:
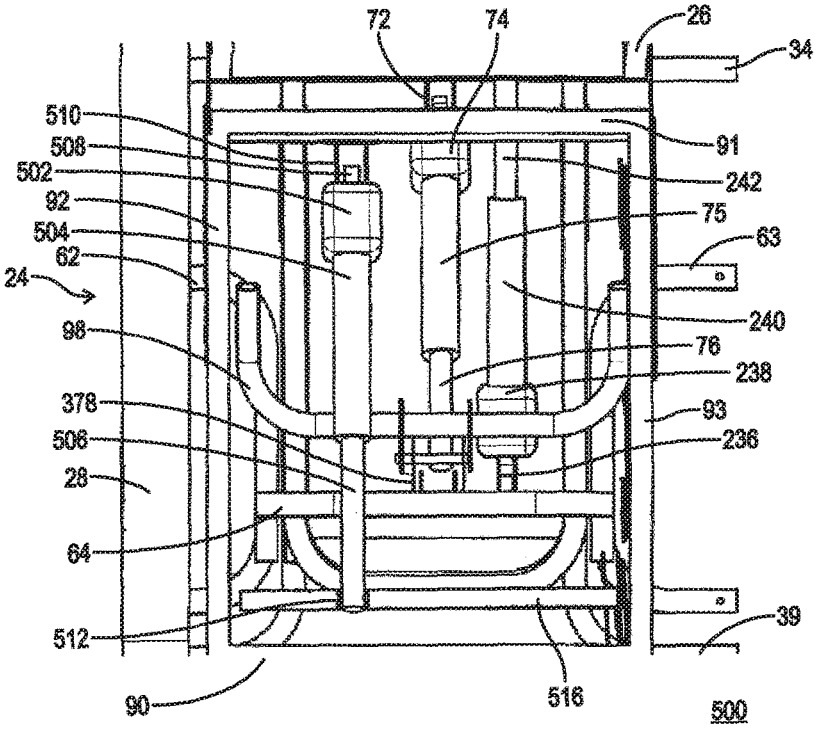
FIG. 36 is a top view of a chair base and lift frame illustrating another embodiment including an independently pivotable footrest.

FIGS. 36-41 illustrate another alternative embodiment of the independently pivoting back frame lift and/or recliner chair of the invention in which chair has been modified to include both an independently pivotable back frame 26 and an independently actuated footrest 27. FIG. 36 is a top view of the chair with the upholstery as well as one of arm frames 28 and certain linkages and other components removed to better illustrate the motor linkages. As in the previous embodiments, the engaging member on the rear side of the housing for lift and recline actuator 74 is pivotably connected to bracket 72 on base frame 34, and the engaging member on the outer end of spindle 76 is connected to bell crank 378. In addition, the engaging member on the outer end of spindle 242 of the back frame actuator 238 is connected to link 260 on bar 244 (see FIG. 12) attached to back frame or backrest 26, and the engaging member on the rear side of the housing for back frame actuator 238 is pivotably connected to connector 236 of seat frame bar 230, also in the manner previously described. A third actuator mechanism for operating the footrest is also now provided, which is similar to the previously described actuator mechanisms in that it includes an electric motor or actuator 502, a sleeve 504 connected to the actuator housing, and a spindle 506 which is telescoping in sleeve 504. Engaging member 508 on the rear side of the housing for footrest actuator 502 is pivotably connected to bracket 510 on rear seat frame member 91 by a pin or pintle. In addition, engaging member 512 on the end of spindle 506 is connected to footrest linkage mechanism 514 as will now be described more fully.

Figure 37:
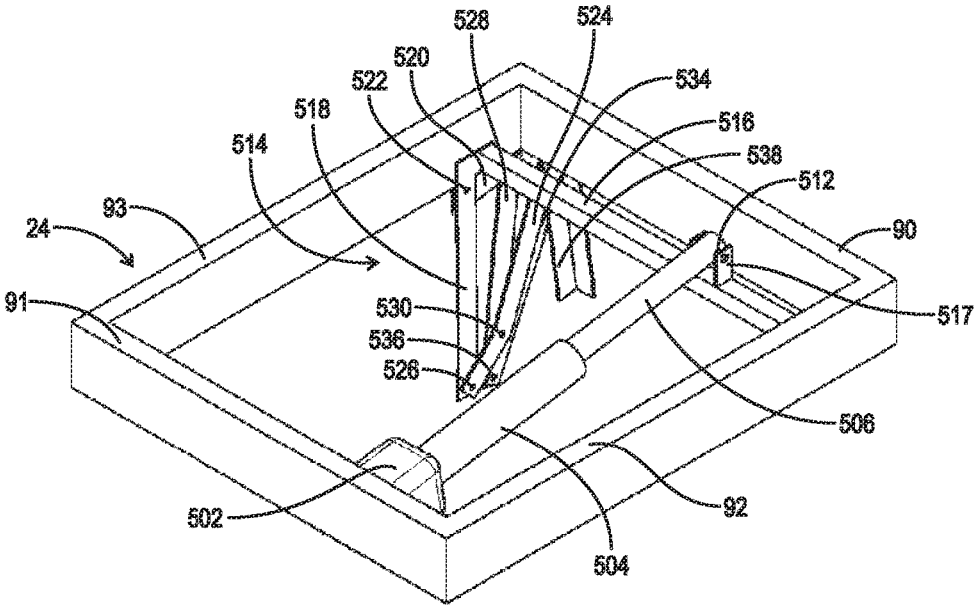
FIG. 37 is a perspective view of the footrest actuator and linkage assembly with the seat frame.
Figure 38:
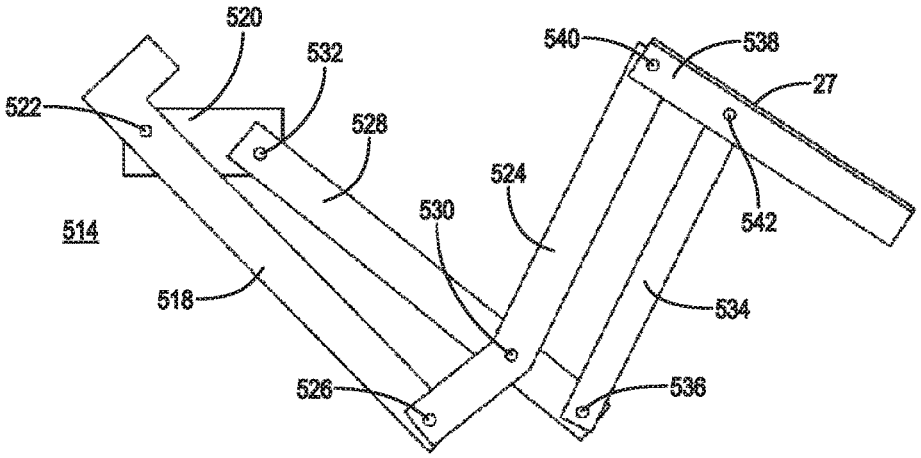
FIG. 38 is an isometric view of the footrest linkage mechanism in an extended position.
Figure 39:
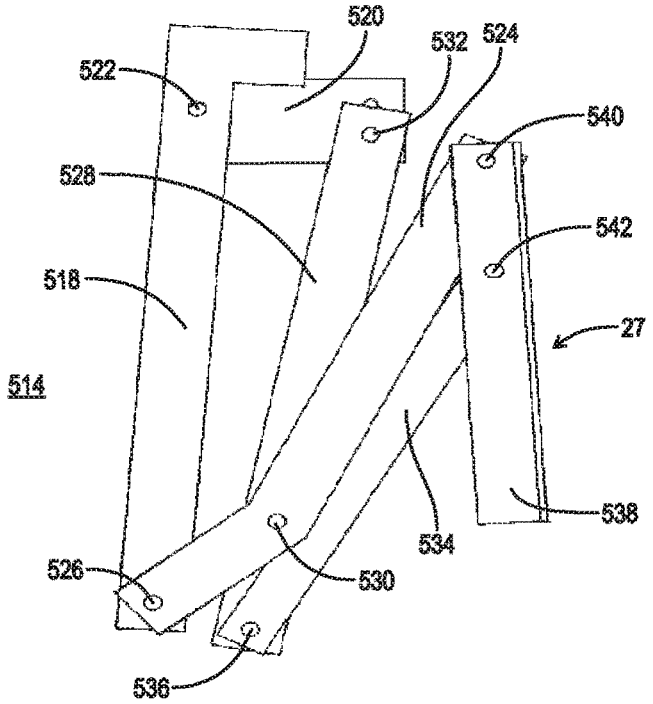
FIG. 39 is an isometric view of the footrest mechanism in a retracted position.

FIG. 37 illustrates the footrest linkage mechanism 514 attached to the seat frame 24 and the footrest actuator, while FIGS. 38-39 illustrate the modified footrest pantograph linkage in an expanded and contracted positions, respectively. Engaging member 512 of footrest actuator spindle 506 is pivotably connected to crossbar 516 of footrest linkage mechanism 514 via bracket 517 by a pin or pintle. Crossbar 516 is pivotably connected on its ends to a link 518 which comprises part of the footrest pantograph assemblies, only one of which is shown in FIG. 37 but it will be understood that a mirror image footrest linkage assembly is connected to the other end of the crossbar 516. Link 518 is pivotably connected to plate member 520 at 522, which plate member 520 is secured to seat frame side member 93. The opposite end of link 518 is pivotably connected to angled link 524 at 526. Angled link 524 is also connected to link 528 at 530. Link 528 is connected to plate 520 at 532, and to link 534 at 536. Footrest frame 538 which supports footrest 27 is connected to the end of link 524 at 540 and to link 534 at 542.

As spindle 506 is drawn inwardly into sleeve 504 by activation of electric actuator 502, preferably using a control system which includes a handheld control device which is connected to actuator 502 to allow for independent operation of such actuator 502, crossbar 516 is pulled rearwardly, which causes the pantograph link 518 and as a result link 528 to pivot in a forward or counterclockwise direction on pivot points 522 and 532. As a result, links 524 and 534 pivot forwardly and upwardly, moving the footrest 27 between a first essentially vertical storage position as shown in FIG. 39 to second generally horizontal or reclining position. Similarly, when electric actuator 502 is operated in a reverse direction, spindle 506 is moved telescopingly out of sleeve 504, causing crossbar 515 to pivot forwardly, which in turn also causes links 518 and 528 to pivot downwardly and in a clockwise direction, and links 524 and 534 as well as footrest 27 are in turn moved downwardly and rearwardly. In one embodiment, footrest actuator 502 may be operated to stop footrest 27 in any position between a vertical storage position and a generally horizontal reclining position (see for example the position of footrest 27 in FIG. 38), except of course when the lift/recline actuator is being moved into a lift position. In addition, back frame 26 is still pivotable completely independent of any movement or the position of both the seat frame and footrest as described above.

Figure 40:
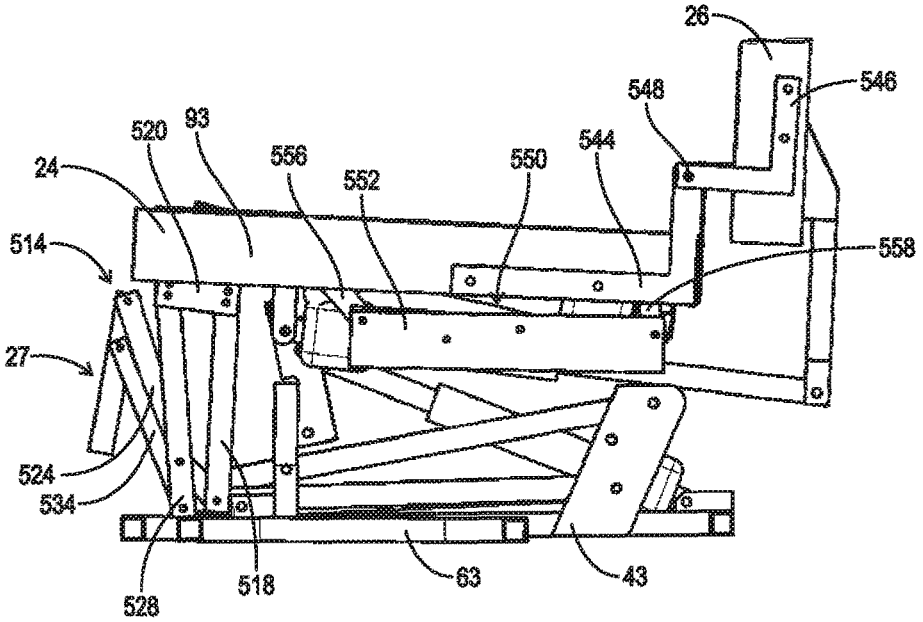
FIG. 40 is a side view of the independent back frame and footrest linkages.
Figure 41:
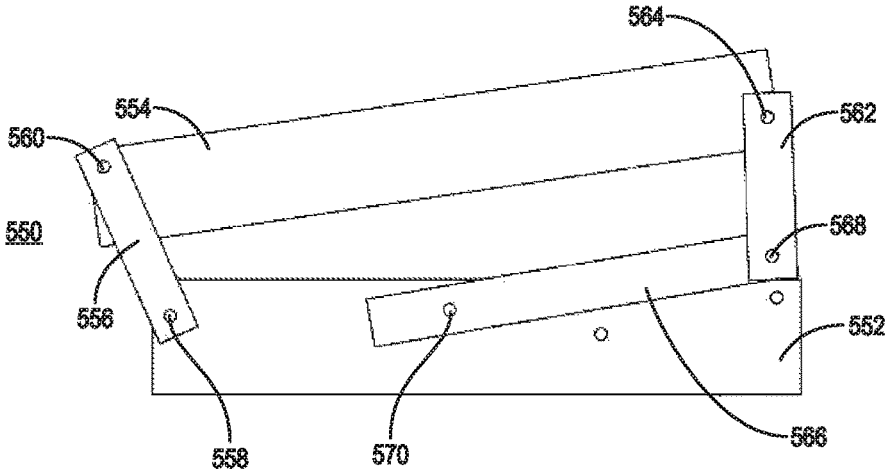
FIG. 41 illustrates the chair frame linkage shown in FIG. 40.

FIGS. 40-41 illustrate the already described footrest linkage mechanism 514 and seat frame linkage mechanism 550 of the presently described embodiment, which separate mechanisms in the previously described embodiments were provided as a combined mechanism. A first L-shaped link 544 is connected to seat frame 24, while another L-shaped link 546 is connected to back frame 26, which links are pivotably connected together at 548 so that back frame 26 is pivotable with respect to the seat frame 24 at point 548. While in the present embodiment L-link 544 is not connected to seat frame linkage mechanism 550, since as described below the mechanism 550 connects to the inner side surface of the seat frame 24, in other embodiments the linkage between the back frame 26 and seat frame 24 may comprise part of the seat frame linkage mechanism, similar to the previous embodiment already described with respect to FIG. 7. Seat frame linkage mechanism 550 connects between the seat frame 24 and the arm frame 28 (shown in earlier embodiments), and as best shown in FIG. 41 includes an arm frame attachment bar 552, and a seat frame attachment bar 554. Arm frame attachment bar 552 is secured to arm frame 28, and seat frame attachment bar is secured to the inwardly facing surface of seat frame 24. Bars 552 and 554 are coupled together connected by a first link 556 which is pivotably connected to bar 552 at 558 and to bar 554 at 560. Another short link 562 is pivotably connected to seat frame bar 554 at 564 on one end and to longer link 566 at 568. Link 566 is then pivotably connected to arm frame connection bar 552 at 570. Linkage mechanism 550 allows the seat frame 24 to pivot with respect to the arm frames 28 when the chair is moved into a reclining position using actuator 74, and to be lifted along with the arm frames when the chair is moved into a lift position. In either position, back frame 26 can be pivoted independent of seat frame regardless of the position of the seat frame 24, and in addition remains in the same relative position with respect to the seat frame 24 as the seat frame 24 position is changed unless actuator 238 is operated to change the relative position of the back frame 26. In addition, unless the chair is in a lift position, footrest 27 can be adjusted separate from both the seat frame 24 and back frame 26. The disclosed arrangement is suited for use with both recliner chairs and lift recliner chairs in which case the arm frames will be connected directly to the base frame rather than to the lift frame.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A recliner chair having a base frame for supporting the chair on a floor comprising:

(a) a recline assembly connected to the chair base frame,
(b) a seat frame connected to the recline assembly,
(c) a pair of armrest members,
(d) a pair of recliner linkage mechanisms connected to the seat frame and to one of the armrest members,
(e) a pivoting footrest operably connected to a pantograph linkage,
(f) a back frame which is pivotable with respect to the seat frame,
(g) a back frame actuator mechanism operably coupled to the back frame for adjusting the inclination of the back frame between a first position and a second position without requiring any movement of the seat frame, said back frame actuator mechanism pivotally connected to the seat frame by a bar member attached to the seat frame,
(h) a recline actuator mechanism operably coupled to the recline assembly for moving the chair between an upright position and a reclining position, and
(i) a footrest linkage mechanism and a footrest actuator mechanism operably connected to the footrest linkage mechanism for independently adjusting the position of the footrest when the recliner is in an upright or reclining position.

2. The recliner chair of claim 1 in which the footrest linkage mechanism is pivotably connected to the seat frame.

3. The recliner chair of claim 2 additionally comprising a lift frame assembly.

4. The recliner chair of claim 1 in which the chair is positionable in both a Trendelenburg and zero-gravity position.

5. The recliner chair of claim 4 in which the back frame is independently pivotable throughout its full range of motion relative to the seat frame and footrest.

6. A recliner chair having an independently adjustable back frame, said chair including a base frame for supporting the chair on a floor, a recline assembly connected to the base frame, a pair of armrests secured to the base frame, and a chair assembly including a seat frame, back frame, and footrest, and a recline actuator mechanism comprising:

(a) linkages for pivotably connecting the back frame with respect to the seat frame such that the position of the back frame is adjustable independent of the position of the seat frame;
(b) at least one recliner linkage mechanism operably connected to said recliner actuator mechanism, and a pantograph linkage for extending and retracting the footrest; and
(c) a back frame actuator mechanism operably coupled between the back frame and recline assembly for adjusting the inclination of the back frame between a first position and a second position, and
(d) a C-shaped bar attached to the seat frame and forming part of the recline assembly, said back frame actuator mechanism operably connected to the C-shaped bar.

7. The recliner chair of claim 6 in which the back frame actuator mechanism is connected between the back frame and another component of the chair assembly or recline assembly that remains in the same relative position with respect to the seat frame as the recline actuator is operated to move the chair between an upright position and a fully reclining position.

8. The recliner chair of claim 7 additionally comprising a lift frame mechanism.

9. A recliner chair having a base frame for supporting the chair on a floor comprising:

a recline assembly connected to the chair base frame,
a seat frame connected to the recline assembly,
a pair of armrest members,
a pair of recliner linkage mechanisms connected to the seat frame and to one of the armrest members,
a pivoting footrest operably connected to a pantograph linkage,
a back frame which is pivotable with respect to the seat frame,
a back frame actuator mechanism operably coupled to the back frame for adjusting the inclination of the back frame between a first position and a second position without requiring any movement of the seat frame, and
a recline actuator mechanism operably coupled to the recline assembly for moving the chair between an upright position and a reclining position,
the seat frame including a front member, rear member and a pair of spaced apart lateral side members connecting between the front and rear members, and a nonlinear bar pivotably connected to the seat frame extending between the side members and containing a bracket member, and a bell crank pivotably connected at a first position to the bracket member, the recline actuator mechanism pivotally connected to the bell crank at a second position, and the back frame actuator mechanism also connected to the bell crank in substantial alignment with said second position.

10. The recliner chair of claim 9 additionally comprising a footrest linkage mechanism and a footrest actuator mechanism operably connected to the footrest linkage mechanism for independently adjusting the position of the footrest when the recliner chair is in an upright or reclining position.

11. The recliner chair of claim 10 in which the footrest linkage mechanism is pivotably connected to the seat frame.

12. The recliner chair of claim 11 additionally comprising a lift frame assembly.

13. A recliner chair having a base frame for supporting the chair on a floor comprising:

a recline assembly connected to the chair base frame, a seat frame connected to the recline assembly, the seat frame including a front member, rear member and a pair of spaced apart lateral side members connecting between the front and rear members, a pair of armrest members, a pair of recliner linkage mechanisms connected to the seat frame and to one of the armrest members, a pivoting footrest operably connected to a pantograph linkage, a back frame which is pivotable with respect to the seat frame, a back frame actuator mechanism operably coupled to the back frame for adjusting the inclination of the back frame between a first position and a second position without requiring any movement of the seat frame or footrest, a pivotable nonlinear bar connected to the seat frame extending between the side members, said bar including a first bracket member and a second bracket member, said back frame actuator mechanism pivotably engaged to the second bracket member, and a recline actuator mechanism operably coupled to the recline assembly for moving the chair between an upright position and a reclining position.

14. The recliner chair of claim 13 additionally comprising a footrest linkage mechanism and a footrest actuator mechanism operably connected to the footrest linkage mechanism for independently adjusting the position of the footrest when the recliner chair is in an upright or reclining position.

15. The recliner chair of claim 14 in which the footrest linkage mechanism is pivotably connected to the seat frame.

16. The recliner chair of claim 15 additionally comprising a lift frame assembly.

17. A recliner chair having a base frame for supporting the chair on a floor comprising:

a recline assembly connected to the chair base frame, a seat frame connected to the recline assembly, a pair of armrest members, a pair of recliner linkage mechanisms connected to the seat frame and to one of the armrest members, a pivoting footrest operably connected to a pantograph linkage, a back frame which is pivotable with respect to the seat frame, a back frame actuator mechanism operably coupled between the back frame and another component of the chair assembly or recline assembly that follows the seat frame as the recline actuator is operated to adjust the inclination of the back frame between a first position and a second position without requiring any movement of the seat frame or footrest, and a recline actuator mechanism operably coupled to the recline assembly for moving the chair between an upright position and a reclining position.

18. A recliner chair having an independently adjustable back frame, said chair including a base frame for supporting the chair on a floor, a recline assembly connected to the base frame, a pair of armrests secured to the base frame, a chair assembly including a seat frame, back frame, and footrest, and a recline actuator mechanism comprising:

(a) linkages for pivotably connecting the back frame with respect to the seat frame such that the position of the back frame is adjustable independent of the position of the seat frame and footrest;

(b) at least one recliner linkage mechanism operably connected to said recliner actuator mechanism, and a pantograph linkage for extending and retracting the footrest; and (c) a back frame actuator mechanism operably coupled between the back frame and recline assembly for adjusting the inclination of the back frame between a first position and a second position, and (d) a nonlinear bar pivotably connected to the seat frame, and the recline assembly including a bell crank which is pivotally connected to the nonlinear bar and to the back frame actuator mechanism in substantial alignment with a connection of the recline actuator mechanism to the bell crank.

* * * * *